US005527033A

United States Patent [19]

Puma et al.

[11] Patent Number: 5,527,033

[45] Date of Patent: Jun. 18, 1996

[54] APPARATUS FOR DETERMINING PERFORMANCE-INDICATING NUMBERS IN SPORTS GAMES, PARTICULARLY IN ICE-HOCKEY

[76] Inventors: Anthony Puma, P.O. Box 443, Center Moriches, N.Y. 11934; John Mizzi, 30 Cramer Rd. R.F.D. 3, Poughkeepsie, N.Y. 12603; Erwin S. Teltscher, P.O. Box 266, Roslyn, N.Y. 11576-0266

[21] Appl. No.: 116,249

[22] Filed: Sep. 2, 1993

Related U.S. Application Data

[63] Continuation-in-part of Ser. No. 579,410, Sep. 7, 1990, abandoned.

[51] Int. Cl.[6] ..... A63F 7/22

[52] U.S. Cl. ..... 273/148 R; 273/57.2; 273/DIG. 27

[58] Field of Search ..... 273/148 R, DIG. 27, 273/57.2; 364/411; 116/222; 377/5; 222/83, 80, 24

[56] References Cited

U.S. PATENT DOCUMENTS

| | | |
|---|---|---|
| 4,133,031 | 1/1979 | Sinn . |
| 4,292,507 | 9/1981 | Hovorka . |
| 4,346,442 | 3/1982 | n/a . |
| 4,398,249 | 5/1982 | Pardo . |
| 4,408,350 | 10/1983 | Donath . |
| 4,852,742 | 8/1989 | Scuorzo . |
| 4,858,120 | 8/1989 | Samuelson . |
| 4,977,503 | 12/1990 | Rudnick . |
| 5,018,736 | 5/1991 | Pearson . |
| 5,062,381 | 11/1991 | Hendricks . |
| 5,153,826 | 10/1992 | Johnson . |
| 5,164,899 | 11/1992 | Sobotka . |
| 5,197,004 | 1/1993 | Sobotka . |
| 5,203,566 | 4/1993 | Ricigliano . |
| 5,345,930 | 8/1993 | Sobotka . |

OTHER PUBLICATIONS

National Hockey League, Official Rule Book, 1977, with Applicant's editorial comments about updated rules for 1979, 1990, 1991, 1993, 1977 originally publication by NHL Information Bureau, 920 Sun Life Bldg., Montreal, Canada; (text included on pp. 9–25 on Applicant's specification).

Timeworks(R) Users Manual, "SwiftCalc 128", ©1984.

NHL Goal Magazine, Nov., 1985 published article about output of Applicant's statistics generated with Applicant's trade secret algorithms which were developed prior to Sep. 7, 1990 filing of Applicant's prior patent application under Ser. No. 07/579,410, the subject matter of which has been included in the present invention filed under Ser. No. 08/116, 249 on Sep. 2, 1993.

(List continued on next page.)

*Primary Examiner*—Jessica J. Harrison
*Attorney, Agent, or Firm*—Alfred M. Walker

[57] ABSTRACT

In a converting device for converting a box score in hockey game eventually to final statistics relating to composite power play, composite penalty efficiency, two-player power-play, two-player penalty efficiency, major power play, major penalty efficiency, composite hot seat, hot seat two-player disadvantage, hot seat major disadvantage, and earned goal average, and wherein the final statistics are, in turn, obtainable from intermediate statistical data, the improvement, wherein the intermediate statistical data are identifiable by a combination of respective letters and/or numbers, and are feedable into a standard calculator or computer so as to obtain the final statistics therefrom and wherein the connecting device is composed of a longitudinal carriage adapted to having a timing chart affixed thereto, and a converting apparatus for obtaining the intermediate statistical data from the box score.

20 Claims, 21 Drawing Sheets

OTHER PUBLICATIONS

Stan Fischler, "Breakaway" Series 1986, sports almanac pp. 9, 22, 23, 24, 27, 58 and 178 published article about output of Applicant's statistics generated with Applicant's trade secret algorithms which were developed prior to Sep. 7, 1990 filing of Applicant's prior patent application under Ser. No. 07/579,410, the subject matter of which has been included in the present invention filed under Ser. No. 08/116, 249 on Sep. 2, 1993.

George Hall, "By the Numbers," NHL Goal Magazine, issue 3, 1987, pp. 2–9, published article about output of Applicant's statistics generated with Applicant's trade secret algorithms which were developed prior to Sep. 7, 1990 filing of Applicant's prior patent application under Ser. No. 07/579,410, the subject matter of which has been included in the present invention filed under Ser. No. 08/116,249 on Sep. 2, 1993.

Anthony Puma, "AP sportsource News Release", Apr. 18, 1988, vol. 1, No. 1, Applicant's published article including output of Applicant's statistics generated with Applicant's trade secret algorithms which were developed prior to Sep. 7, 1990 filing of Applicant's prior patent application under Ser. No. 07/579,410, the subject matter of which has been included in the present invention filed under Ser. No. 08/116, 249 on Sep. 2, 1993.

Anthony Puma, "Welcome To AP Sportsource National Hockey League Statistic's Network", news release, Nov. 1988 Applicant's published article including output of Applicant's statistics generated with Applicant's trade secret algorithms which were developed prior to Sep. 7, 1990 filing of Applicant's prior patent application under Ser. No. 07/579,410, the subject matter of which has been included in the present invention filed under Ser. No. 08/116,249 on Sep. 2, 1993.

Anthony Puma, AP Sportsource, "Re: National Hockey League: Special Teams Statistics/Time Frame", news release, Jan. 18, 1990 Applicant's published article including output of Applicant's statistics generated with Applicant's trade secret algorithms which were developed prior to Sep. 7, 1990 filing of Applicant's prior patent application under Ser. No. 07/579,410, the subject matter of which has been included in the present invention filed under Ser. No. 08/116,249 on Sep. 2, 1993.

Anthony Puma, AP Sportsource, "Att: All Media/ NHL Officials" news release, Mar. 21, 1990 Applicant's published article including output of Applicant's statistics generated with Applicant's trade secret algorithms which were developed prior to Sep. 7, 1990 filing of Applicant's prior patent application under Ser. No. 07/579,410, the subject matter of which has been included in the present invention filed under Ser. No. 08/116,249 on Sep. 2, 1993.

Anthony Puma, "AP Sportsource National Hockey League Statistics–Period Ending Apr. 1, 1990" Applicant's published article including output of Applicant's statistics generated with Applicant's trade secret algorithms which were developed prior to Sep. 7, 1990 filing of Applicant's prior patent application under Ser. No. 07/579,410, the subject matter of which has been included in the present invention filed under Ser. No. 08/116,249 on Sep. 2, 1993.

"The Hockey News", weekly newspaper, Dec. 14, 1990, published article about output of Applicant's statistics generated with Applicant's trade secret algorithms which were developed prior to Sep. 7, 1990 filing of Applicant's prior patent application under Ser. No. 07/579,410, the subject matter of which has been included in the present invention filed under Ser. No. 08/116,249 on Sep. 2, 1993.

Toronto Daily Star newspaper, Oct. 22, 1991, "It's a Whole New Frame of Mind", published article about output of Applicant's statistics generated with Applicant's trade secret algorithms which were developed prior to Sep. 7, 1990 filing of Applicant's prior patent application under Ser. No. 07/579,410, the subject matter of which has been included in the present invention filed under Ser. No. 08/116,249 on Sep. 2, 1993.

Anthony Puma, Copyright registration No. TXU 578 944, Jul. 23, 1993, "Hockey: Special Teams Statistics/Time Frame Basis".

PORTION OF TIMING CHART – SECOND PERIOD

PORTION OF BOX SCORE (SECOND PERIOD):

3. EDM, J.DOE (29) 3:19
4. EDM, A.DOE (34) 4:25
5. WPG, B.DOE (32) 7:26

PEN – C.DOE, WPG (HOOKING), 2:16
D.DOE, WPG (MAJOR), 3:07
E.DOE, EDM (ROUGHING), 6:56

EXAMPLE A

EXAMPLE B

EXAMPLE C#1

EXAMPLE C#2

EXAMPLE D

EXAMPLE E

APPARATUS FOR DETERMINING PERFORMANCE-INDICATING NUMBERS IN SPORTS GAMES, PARTICULARLY IN ICE-HOCKEY

This application is a continuation-in-part application of application Ser. No. 07/579,410, filed Sep. 7, 1990, now abandoned.

BACKGROUND OF THE INVENTION

1. Field of the Invention

The field of this invention is an apparatus for determining "performance-indicating numbers" applicable in a variety of fields, such as life sciences, e.g. biology and medicine, games of all kinds, including military games, and all kinds of scoring or evaluation of sports, although this particular application is specifically geared to performance-indicating numbers in ice-hockey games.

2. Description of Related Art

Searches were conducted in the arts of computer simulation, sports statistics, and kits. The results of these searches are summarized below.

Sobotka et al, U.S. Pat. No. 5,197,004, issued Mar. 23, 1993, filed May 8, 1989, as Ser. No. 349,028, and relating to a method and an apparatus for automatic categorization of applicants from resumes, relates to a method and an apparatus for automatically selecting job categories within which an applicant should be placed, using only the applicant's resume.

The closest Sobotka et al come to the present patent application is a part of the main claim (claim 1) in which they recite . . . "summing the weights for each job category; selecting the job category or categories with the highest weights; and delivering as output either computer-compatible or text form the job category or categories with the highest weights."

Sinn, U.S. Pat. No. 4,133,031, issued Jan. 2, 1979, filed Apr. 4, 1977, relates to an electronic speed rating calculator and method. Sinn discloses an apparatus and a method for calculating a comparative speed rating for an entrant in a race, such as a horserace, so that the entrant's performance can be compared with the performance of other entrants.

Although the methodology of Sinn '031 could conceivably be applied to the subject matter of the present invention, the implementation of his method and apparatus is quite different from applicant's.

Sobotka et al, U.S. Pat. No. 5,164,899 relates to a method and apparatus for computer understanding and manipulation of minimally formatted text documents, such as resumes, purchase forms insurance forms, bank statements, etc. The invention manipulates the digital image of a document, converting each block into an ASCII character file. The manipulated text is either stored or outputted in a form which facilitates its use and readability.

Sobotka et al, U.S. Pat. No. 5,345,930, filed May 1, 1989, relates to a method and apparatus for use with a computer, which analyzes text documents using both sophisticated text pattern matching techniques which are insensitive to typographical errors, and spatial analysis techniques for analyzing the spatial structure of the text document.

Pardo et al, U.S. Pat. No. 4,398,249, issued Aug. 9, 1983, filed Aug. 12, 1970, as Ser. No. 63,185, relates to a process and apparatus—compiler program—carried out on a digital computer for converting a source program into an object program. The source program is entered into a first storage area of a computer. The symbolic source program is preferably first codified into a computer executable code by the compiler program.

The compiler program examines each formula repeatedly whether it has been identified, until all formulas have been defined. Its output is an object program which is executable by the computer.

Samuelson, U.S. Pat. No. 4,858,120 issued Aug. 15, 1989, filed Mar. 19, 1987, as Ser. No. 27,359, relates to a method for controlling arrival of servers; it includes measuring durations of service, estimated expected duration of service, estimated expected transit time, determining time in progress of each service, determining a number of currently busy servers expected to be available when by that time another arrival could reach them; computing total number of servers expected to be available; and controlling a means to correspond to the resulting number of servers expected to be available.

Scuorzo, U.S. Pat. No. 4,852,742, issued Aug. 1, 1989, filed Dec. 8, 1988, as Ser. No. 281,533, relates to a housing kit, which provides for rotation of a toothbrush head for mixing baking soda and an oxygenating agent within the housing kit. Provisions are made for maximizing the housing during use.

Ricigliano, U.S. Pat. No. 5,203,56, issued Apr. 20, 1993, filed Nov. 15, 1991, as Ser. No. 792,636, relates to an indoor miniature golf game having a plurality of fairways and greens.

Sequential visual activity segments with intermediate target areas are provided on the fairways between the tees and the greens. Various materials both visually and physically simulate the landscape, so that the golf ball travels quickly over the greens, but is slowed down and caught by rough or water-simulated areas.

Johnson, U.S. Pat. No. 5,153,826, issued Oct. 6, 1992, filed Nov. 28, 1989, Ser. No. 442,315, relates to a hand-held, portable device for keeping track of the in-play and error shots of a specific type of shot made by a player in a sports event. It comprises at least a first display for indicating at least the percentage of the cumulative number on in-play shots relative to the cumulative number of the total in-play and error shots; a first key switch for inputting each in-play shot; a second key switch for inputting each error shot; and a microprocessor for keeping track of the total number of in-play and error shots, and for calculating at least the percentage of the cumulative number of the in-play shots relative to the cumulative number of the shots made by the player, whereby the percentage display is updated each time one of the first and second keyswitches is depressed.

Pearson et al, U.S. Pat. No. 5,018,736, filed Oct. 27, 1989, as U.S. Ser. No. 428,866 relates to an interactive contest system which permits competition among a plurality of remote participants.

The system includes a central controller, storage devices for storing a Contest Roster, from which each participant selects a team roster, a plurality of Touch-Tone™ telephones linked to the controller, and a publication such as a newspaper distributed to all participants. Each participant's team roster is evaluated on a periodic basis according to a formula for calculating each member's score employing a database of variable performance statistics which reflect the roster members' actual performances. Team roster totals are compared for discrete periods of competition to determine which participants have accumulated the highest score. This invention, although broadly similar to the present invention, implements the results totally differently.

Hendricks, U.S. Pat. No. 5,062,381, issued Nov. 5, 1991, filed Aug. 29, 1990, as Ser. No. 575,375, relates to a game data board. The board has an upper surface and a lower surface; a first marking slide; a first passage in the upper surface for receiving the first marking slide and for permitting movement of the first marking slide therein; and a second marking slide with arrangements similar to the first marking slide. Indicia on the bottom surface of the first passage indicate scores or statistics for at least one sport or game.

Rudnick et al, U.S. Pat. No. 4,977,503, issued Dec. 11, 1990, filed Oct. 28, 1988, Ser. No. 259,160, relates to a small hand-held electronic device containing all of the normally interesting statistics relating to baseball or football players and teams.

The system electronics include a microprocessor and a large solid state non-volatile memory array containing the detailed statistical records. In a baseball embodiment, the user turns on the device and selects a player or team by entering two or three characters of the name via alphabet keys. The device displays the cumulative statistics; previous year statistics are displayed by the use of cursor keys. A new statistic may be obtained by pressing a key corresponding to that statistic, while a new player or team may be selected by depressing the first two or three letters of the name and the beginning of the process anew.

Hovorka, U.S. Pat. No. 4,292,507, issued Sep. 29, 1981, filed Mar. 9, 1978, Ser. No. 884,762 relates to a calculating and recording device for determining and retaining play statistics of a football game. In a preferred embodiment marker means include a plurality of varied color, shape or size of pegs and/or cooperative rings, each of which represents a certain type of passing, rushing or kicking play, first down or other statistics, and the like, and a rule is provided with sufficient receiver capability to record substantially all of the plays made by a team in a single quarter of half of the football game. A receiver is also employed for locating removable markers in a groove which receives the slide, thereby permitting markers to be placed indicative how each drive ends, and providing a reference stop for the slide and permitting its use for indicating the number of plays in the present drive. The markers also permit identification of each play in a series of plays, such as first, second, third or fourth down play.

It has been possible to obtain selected performance statistics, for example, of a team engaged in competitive hockey scores, by extensive manipulation from a box score, generally provided by newspapers, but to the best of applicant's knowledge, no apparatus existed up to the date of writing, where this manipulation was performed either automatically, or at least semi-automatically by a machine. The present application seeks to remedy this shortcoming.

REFERENCE TO COPYRIGHTED MATERIAL

The present invention makes use of certain text and mathematical formulas, which formulas are subject to Applicant's copyrighted information contained in Applicant's computer program and user's manual, as protected by Copyright Registration number TXU 578 944 of Jul. 23, 1993, entitled "Hockey: Special Teams Statistics/Time Frame Basis."

All copyright rights are reserved, and no reproduction or use of the material contained in any forthcoming patent may be made, without the express written permission of the Applicant, except for incidental photographic reproduction of the text of any forthcoming patent issuing herein.

REFERENCE TO APPENDIXES

Attached hereto as Appendix I, at pages 1A–18A, are the rules governing the game of ice hockey, which rules are applied during use of the subject matter of the present invention.

Attached hereto as Appendix II is a typical hockey game box score.

Attached hereto as Appendix III is a computer generated print out of the output of the typical hockey game box score of Appendix II, after utilizing the subject matter of the present invention.

BASIS FOR THE INTERMEDIATE FORMULAE IN THE APPARATUS ACCORDING TO THE INVENTION

Composite Power Play ((D5)+(2*G5)*(60)+(E5)+(2*H5)/(B5)/(60)Int*(60.6))

B=Total power play goals scored by a team.

D=Accrued number of minutes in which a team has a one player advantage.

E=Accrued number of seconds in which a team has a one player advantage.

G=Accrued number of minutes in which a team has a two player advantage.

H=Accrued number of seconds in which a team has a two player advantage.

Int=Integer

Composite Penalty Efficiency ((PS)+(2*S5)*(60)+(Q5)+(2*T5)/(N5)/(60)Int*(60.6))

N=Total power play goals scored against a team.

P=Accrued number of minutes in which a team has a one player serving penalty time.

Q=Accrued number of seconds in which a team has a one player serving penalty time.

S=Accrued number of minute in which a team has a two players serving penalty time.

T=Accrued number of seconds in which a team has a two players serving penalty time.

Int=Integer

Two Player Power Play ((G5*60)+(H5)/(F5)/(60)Int*(60.6))

F=Number of goals scored by a team when it has a two player advantage.

G=Accrued number of minutes in which a team has a two player advantage.

H=Accrued number of seconds in which a team has a two player advantage.

Int=Integer

Two Player Penalty Efficiency ((S5*60)+(T5)/(R5)/(60)Int*(60.6))

R=Number of goals scored against a team when two players are serving penalty time.

S=Accrued number of minutes in which a team has two players serving penalty time.

T=Accrued number of seconds in which a team has two players serving penalty time.

On a separate spreadsheet the major time categories are compiled. The equation is identical to two men equation.

Int=Integer

Major Power Play ((G5*60)+(H5)/(F5)/(60)Int*(60.6))

F=Number of goals scored by a team when it has a one player advantage.

G=Accrued number of minutes in which a team has a one player advantage.

H=Accrued number of seconds in which a team has a one player advantage.

Int=Integer

Major Penalty Efficiency ((S5*60)+(T5)/(R5)/(60)Int*(60.6))

R=Number of goals scored against a team when one player is serving penalty time.

S=Accrued number of minutes in which a team has one player serving penalty time.

T=Accrued number of seconds in which a team has one player serving penalty time.

The goaltenders categories are compiled on a separate spreadsheet. The three equations for the Hot Seat category are identical to composite penalty efficiency, two man penalty efficiency and major penalty efficiency.

Int=Integer

Composite Hot Seat ((P5)+(2S5)*(60)+(Q5)+(2*T5)/(N5)/(60)Int*(60.6))

N=Total power play goals scored against a goaltender.

P=Accrued number of minutes faced by a goaltender when his team has one player serving penalty time.

Q=Accrued number of seconds faced by a goaltender when his team has one player serving penalty time.

S=Accrued number of minutes faced by a goaltender when his team has two players serving penalty time.

T=Accrued number of seconds faced by a goaltender when his team has two players serving penalty time.

Int=Integer

Hot Seat Two Player Disadvantage ((S5*60)+(T5)/(R5)/(60)Int*(60.6))

R=Number of goals scored against a goaltender when two players are serving penalty time.

S=Accrued number of minutes faced by a goaltender when his team has two players serving penalty time.

T=Accrued number of seconds faced by a goaltender when his team has two players serving penalty time.

Int=Integer

Hot Seat Major Time Disadvantage ((S5*60)+(T5)/(R5)/(60)Int*(60.6))

R=Number of goals scored against a goaltender when one player is serving penalty time.

S=Accrued number of minutes faced by a goaltender when his team has one player serving penalty time.

T=Accrued number of seconds faced by a goaltender when his team has one player serving penalty time.

Int=Integer

Earned Goal Average ((R5)–(S5)/(Q5–T5)X(60)Int*(60.6))

R=Total goals against goaltender.

S=Power play goals against goaltender.

T=Total power play time faced by goaltender.

Q=Total minutes played by goaltender.

Int=Integer

*=Symbol for arithmetical function for multiplication.

/=Symbol for arithmetical function for division.

+=Symbol for arithmetical function addition.

–=Symbol for arithmetical function subtraction.

5=Denotes applicable identification column.

Procedure for Scoring

Acquire box score from newspaper as noted in the attached Appendix II illustration.

All power play, and penalty killing time is "actual time" accrued, as opposed to percentage formulation currently in use.

Power play time for Team "A" is penalty killing time for Team "B".

When Team "A" scores a power play goal in 25 seconds, they are credited 1 for 0:25 seconds of composite time.

When Team "A" is charged with a penalty while on the power play, it is charged only for accrued time while on power play. Example: power play start at 4:10 it is charged with penalty at 4:29; Team "A" is charged 0 for 0:19 of composite time.

When Team "A" is on the power play and its opponent is charged with additional minor penalty, the two player time accrued is doubled. Example: Team "B" is charged with minor penalties at 4:10, and 5:40. Should Team "A" fail to score during this sequence, it is charged 0 for 3:00 or one-man time, 0 for 0:30 of two player time; and 0 for 4:00 of composite time.

When Team "A" has a two player advantage and scores a goal in 0:30, it is charged 1 for 1:00 of composite time, but 1 for 0:30 of two player time.

When Team "A" is on the power play and its opponent is charged with an additional minor penalty while already two players down, the third penalty time does not commence until either;

A. Team "A" scores a two player advantage goal; Example: Team "B" is charged with minor penalties at 4:10, and 4:19, when Team "B" is charged with a third minor penalty at 4:51 and Team "A" scores at 5:01, the third minor penalty time will commence at 5:01, or B. The first penalty expires without a goal being scored by Team "A". Example: Under the circumstances described above, when the first penalty to Team "B" expired at 6:10, it is at 6:10 that the penalty time will commence to expire on the third penalty charged to Team "B", thus, Team "A" remains on a two player advantage until the second penalty expires at 6:19. Had Team "A" fail to score at all during this sequence, the third penalty would have expired at 8:10. The power play time charged to Team "A" would be the following: 0 for 2:00 of one-player, 0 for 2:00 of two player time, 0 for 6:00 composite time.

When Team "A" has a five-minute major power play and fails to score it is charged 0 for 5:00 of major-time, and 0 for 5:00 of composite time. When Team "A" has a five-minute major power play and scores one goal it is charged 1 for 5:00 of major-time, and 1 for 5:00 of composite time.

When Team "A" has a five-minute major power play and Team "B" is charged with an additional penalty of any type, all time accrued by Team "A" is charged as two player time until there is no longer a two player advantage. Ex: Team "B" is charged with a major penalty at 5:00. At 6:30 Team "B" is charged with an additional minor penalty. Should Team "A" fail to score during this sequence the power play time accrued by Team "A" would be as follows: 0 for 3:00 of major time, 0 for 2:00 of two player time and 0 for 7:00 composite time. All power play time/penalty-killing time is charged to the goaltender who was playing goal for the defending team at that segment of the game. When a goaltending change is made the penalty-killing time is charged to the replacement goaltender thereby creating the "Hot-Seat" compilation. The method used is the same formulation which is used for the Teams' penalty-killing ranking; two player time, major time and composite time are compiled for this category as well.

In the event that a game is played in its entirety without a power play occurring for a team/teams, no new data shall be added to the applicable category/team for that particular game.

There exists one additional goaltender characteristic, namely the "Earned Goal Average" Category. This statistic is also a derivative of power play time; in the equation given below, it will be seen, however, that the power play time and power play goals are extracted from other goaltender' statistics, i.e. total minutes played and total goals against a goaltender.

The formula given calculates even-strength goals divided by even-strength time, multiplied by sixty, (which is the length of the game), and the results are the E.G.A. statistics. For example, a very good E.G.A. would be an average of 1.50 even-strengths goals per game. A very poor average would be 4.50 even-strength goals per game. All goaltender's statistics are a by-product of teams composite statistics.

The formula for the E.G.A. reads then as follows:

$$((R4)-(S4)/(Q4-T4)/(60))$$

wherein

R equals total goals against goaltender

S equals power play goals against goaltender

Q equals total minutes played, and

T equals power play time faced

In use the present invention is used to provide an apparatus and method for obtaining selected performance statistics, for example, of one or more teams engaged in competitive hockey scores, by extensive manipulation of time frame statistics, from a game box score, generally provided by newspapers, as shown in the attached illustrated game box score for the Edmonton Oilers vs. the Winnipeg Jets on Apr. 1, 1990 in Appendix II herein.

For clarity and illustration, the aforementioned box score is broken down in the attached chart of Appendix III herein, and presented in chronological time frame order, showing the various power plays and performance opportunities during the entire sixty minutes of the three twenty minute periods of the hockey game of Apr. 1, 1990.

At the end of the chronological chart of the Apr. 1, 1990 hockey game, there is shown a further chart of the breakdown of the accrued time for each power play, and by categories, such as one man time, two man time and major time.

Finally, at the end of the chronological chart of the game, there is shown the composite power play time and the power play goals scored for each respective team.

The particular chart of Apr. 1, 1990, in Appendix III herein, shows that on that date Winnipeg scored 1 power play goal over 20 minutes and 40 seconds accrued time, but Edmonton scored 2 power play goals in a much shorter time of 14 minutes and 39 seconds.

Therefore, the statistics generated by the present invention show that Edmonton performed better, because Edmonton only took an average of 7 minutes and 20 seconds for each power play goal scored in the game, whereas Winnipeg took an average of 20 minutes and 40 seconds for its single power play goal.

Thus, Edmonton is shown to be three times more efficient than Winnipeg in scoring power play goals where Edmonton has the power play advantage when one or more of the opposing Winnipeg players were serving penalty time on the penalty bench, and therefore putting Winnipeg at a disadvantage.

Likewise, the statistics shown in Appendix III herein and generated by the present invention also show Winnipeg's weakness, in its apparent inability to take advantage of the time when Edmonton was short of at least one player during a penalty time, as well as Winnipeg's inability to score a power play goal over an extended period of time, until twenty minutes had elapsed.

SUMMARY OF THE INVENTION

Specifically, in a converting device for converting a box score in a hockey game eventually to final statistics relating to composite power play, composite penalty efficiency, two-player power-play, two-player penalty efficiency, major power play, major penalty efficiency, composite hot seat, hot seat two-player disadvantage, hot seat major disadvantage, and earned goal average, and wherein the final statistics are, in turn, obtainable from intermediate statistical data, an improvement will be described hereinbelow.

In that improvement the intermediate statistical data are identified by a combination of respective letters and/or numbers, and are fed into a standard calculator or computer so as to obtain the final statistics therefrom. The improvement is best understood with reference to a description, appearing herein-below, to be read in conjunction with the illustration of the accompanying figs. It is advantageous if a longitudinal carriage is provided, and if converting means are used to obtain intermediate statistical data from the box score, and the converting means include a longitudinal timing chart disposed in parallel with a first axis, calibrated along its ordinate sequentially at predetermined major intervals, while along its abscissa and parallel to a second axis perpendicular to the first axis there are denoted generally a first team, followed sequentially by a second team which normally opposes the first team.

Additionally it is advantageous if tape holding means defining a center axis are used. The center axis can be positioned in parallel with the second axis, and tape holding means are preferably adapted for carrying a plurality of at least three tape reels with respective differently identified tapes.

Advantageously tape unrolling means are provided for unrolling at least one of the tapes from the tape holding means, and tape dispensing means are preferably used for dispensing the at least one of the tapes; additionally tape dispensing control means are preferably employed for controlling the tape dispensing means.

Advantageously mobile length measuring means can operably be moved in a forward direction within 180 degrees along generally arbitrary moving directions from a starting position to an end position, for measuring a predetermined length of at least the one of the tapes, so as to substantially be independent of the movement-direction, and thus become substantially movement-direction independent.

This is so, provided that a path taken by the mobile length measuring means between the above-noted positions does not have a component in any direction opposite to the forward direction.

It is additionally preferable if conversion means are used for changing the mobile length measuring means to stationary length measuring means with respect to the carriage, and if marking means on the tape dispensing means are used for marking chosen or other parameters on the timing chart. The tape selection means are preferably spaced apart from, opposite to, and cooperating with the tape holding means for selecting one of the tapes, and the tape restraining means are preferably used for restraining the one of the tapes to follow a predetermined path.

It is advantageous if cutting means are employed for cutting off the predetermined length of the one of the tapes from the dispensing means, and if adhesive means are employed for laying down and adhering the predetermined length of the one of the tapes onto, and to the timing chart, respectively, so as to extend in parallel with the first axis.

Additionally, it is preferable if engagement means are employed between the timing chart, and the tape unrolling means, and if translatory moving means are used for automatically moving the carriage in a direction parallel to the first axis and relative to the timing chart along translation direction between an initial position denoting zero tape travel, and a second position away from the initial position, so as to denote distance traveled from the initial position.

Preferably at least the tape dispensing means, the control means, the stationary length measuring means, the marking means, the tape selection means, the tape unrolling means, the tape restraining means, and the cutting means are contained in the carriage, so that the carriage can be manually moved in a direction parallel to the second axis, and so as to obtain a selected position of the carriage with respect to the timing chart.

The converting means preferably use differently marked tapes with different respective colors.

The tape unrolling means preferably comprise an electric motor rotatably attached to the carriage, and define at least one motor axis substantially parallel with the second axis, at least one of the tape reels can be coupled to the motor, and tape guiding means are provided to guide the one of the tapes along a predetermined path within the carriage.

The cutting means comprises preferably blade guiding means secured to the carriage, so that the blade normally passes through the blade guiding means, and wherein a wedge is formed in one longitudinal side of the carriage, and an exit slot is defined between the wedge and a remaining part of the one longitudinal side, and wherein blade guiding means are located above the exit slot, so that the at least one of the tapes can be passed over the gap on being unrolled, whereby the predetermined length is cut off from the one tape upon the blade passing over the exit slot, when actuated by the length measuring means.

The adhesive means preferably include two sets of ridges spaced apart from one another on each side of the one of the tapes, respectively, so as to be equivalent to respective seconds in time, and the timing chart preferably includes ridges on a front surface thereof spaced from one another, and cooperating with corresponding ridges on the one of the tapes, so that the cooperating ridges operatively mate with one another.

The converting means preferably further comprise a mounting and alignment frame, which can be aliened with the timing chart in discrete steps, and where each of the steps corresponds to an interval of one minute, and includes a rail parallel to the second axis, wherein the second axis is substantially horizontal, and a first travel frame is arranged in the mounting and alignment frame, and has a longitudinal base provided with a bore, so that the rail can be passed therethrough, and so that the first travel frame is slidable along the rail in a direction parallel to the second axis.

The longitudinal base of the first travel frame preferably includes two outside arms extending in parallel opposite one another, and in a direction away from the longitudinal base, and at right angles thereto, and preferably further includes a second travel frame nestled between the outside arms, which is slidable therebetween in a direction substantially parallel to the first axis. It is advantageous if the second travel frame includes the tape dispensing control means in the form of a numeric key pad provided with at least ten actuating keys, at least a four digit display, and a plurality of function buttons providing at least for offset-, length-, reset-, and start-modes.

The tape selection means preferably comprise manually actuatable guide means for selecting the one of the tapes, and drive wheels for moving the carriage forwardly or rearwardly. The tape holding means are advantageously provided with a reel holder mounted on the carriage, and being adapted to hold a plurality of tape supply reels, and wherein the guide means substantially define a first plane, and include a U-shaped bracket having arms extending therefrom in parallel with, and opposite to one another, and formed with horizontally aligned openings, respectively.

It is further advantageous if a manually operable reel-selector bar extending substantially at right angles to the plane of normally actuatable guide means extending from an interior of the carriage is provided, and wherein the side opposite to the one side is formed with a longitudinal guide slot, and with a plurality of reel-identifying indents communicating with the horizontal guide slot, and extending at right angles thereto, and wherein the plurality of indents correspond to a plurality of respective tape-carrying reels, and the longitudinal guide slot extends in a direction parallel to the second axis. Advantageously a tape-moving or reel selection shaft, or reel-coupling means carrying shaft is provided which has a polygonal cross-section on a center portion thereof, and fits into the openings of the two arms of the guide means, respectively, and carries reel-coupling means slidably connected to the reel-selection shaft along an axis thereof parallel to the second axis for positioning the reel-coupling means along an axis thereof opposite a selected one of the reels, whereby the selected one of the one of the tapes is automatically movable in a direction parallel to the first axis, until the one of the tapes reaches the tape exit slot formed in the carriage, and thereafter is movable by the control means, until the predetermined length of offset is reached, and is adhesively superimposable by means of the cooperating and mating ridges onto the timing chart at a desired location of the one of the tapes.

The carriage preferably comprises first and second axles or shafts coaxial with the tape-moving shaft, and the shaft of the drive wheels, respectively, and solenoid-actuatable first and second clutch brake assemblies are preferably coaxial with the tape moving shaft, and the shaft of the drive wheels, respectively.

The plurality of tapes preferably includes four tapes, and wherein the polygonal cross-section is preferably a square cross-section which has four sides corresponding to the four tapes, respectively.

The one side of the carriage preferably comprises a floor, and wherein the tape restraining means preferably comprises an elastomeric pressure pad generally juxtaposed with a portion of the floor, and part of the exit gap, and the one of the tapes can be passed through the exit slot.

The length measuring means preferably has a generally longitudinal shape, and preferably includes a piezo-electric or magnetic transducer having an input, a pulse shaper having an input for accepting an input of the transducer, a counter having forward or backward switchable modes, and having a first input for accepting the output of the transducer, a second input thereof being connected to a groundable reset switch for resetting the counter to zero, a binary-to-digital converter accepting on an input thereof the output of the counter, and displaying the latter-named output, and means for actuating the cutting means upon the counter, operating in the backward mode, having reached the predetermined count. It is advantageous, if the length measuring means had a longitudinal shape, and is provided with at least two guide-posts on an input end thereof, and wherein the one side of the carriage formed with the exit slot includes a fixed-location transducer having an output end of a stylus connected with an input thereof, and the stylus is in operative contact with the ridges of the timing chart, the fixed-length transducer being additionally formed on an output end thereof with two recesses mating with respective of the latter-named guide-posts for being snapped thereinto, and wherein the length measuring device is formed with an input for accepting an output of the fixed-location transducer, whereby, upon the output of the fixed location transducer being connected to the input of the truncated length-measuring means, and upon the guide-posts being snapped into respective of the recesses, the longitudinal shape becomes connected to, and rigid with the carriage of the converting device, so that the mobile length measuring means becomes a fixed-location length measurement means with respect to the carriage. The moving means preferably comprise an actuatable electric motor provided with a pulley, and rotatably secured to the carriage, and belt-and/or chain means engageable with the motor, and with the first and second shafts, respectively.

The carriage is advantageously provided with actuatable brake and clutch means selectively acting as brake or clutch, respectively, whereby each of the brake and clutch means can be actuatated to be positively coupled to each of the axles, respectively, or be free-wheeling.

The carriage further advantageously comprises a drive solenoid having a housing, a plunder substantially resting in the housing, but having one end thereof disposed outside of the housing, a restraining spring extending between the housing and the other end of the plunger, ball-joint coupling having one end joined to the one end of the plunger, a splined shaft joined to the other end of the plunger, a substantially cylindrical housing rigid with the drive solenoid, and having an end friction surface thereof facing away from the solenoid, a brake/clutch disk having a splined bore, so as to be slidable on the splined shaft, each lateral side of the brake/clutch disk having a clutch-friction surface, a timing-belt pulley having a friction surface facing one of the friction surfaces of the brake/clutch disk, and having an outwardly extending driving shaft attached thereto, whereby, on the solenoid being energized, the friction surface of the pulley engages the one friction surface of the brake/clutch disk, so as to be coupled thereto, so that the driving shaft is drivable, while, on the solenoid becoming de-energized, the restraining spring retracts the plunger, so that the other friction of the brake/clutch disk is coupled to the end friction surface of the housing, and that the pulley and its driving shaft become free-wheeling.

It is further advantageous if a length measurement means is provided with a piezo-electric or magnetic transducer having an input, a pulse shaper having an input for accepting the output of the transducer, a counter having forward or backward switchable modes, and having a first input for accepting the output of the transducer, a groundable reset switch for resetting the counter to zero being connected to a second input of said counter, a binary-to-digital converter accepting on an input thereof the output of the counter, and display means for viewing an output of the converter.

BRIEF DESCRIPTION OF THE DRAWINGS

The invention will be better understood in referring to the accompanying drawings, in which.

DESCRIPTION OF THE PREFERRED EMBODIMENTS

As has already been pointed out, it is an object of this apparatus, according to the present invention, to analyze specific aspects of the present game, in this instance ice hockey.

This is done in order (1) to rate a selected team based on its performance in different aspects of the game, and (2) to rank the team accordingly, such as by the sum of the different aspects of (1).

Figure 1:
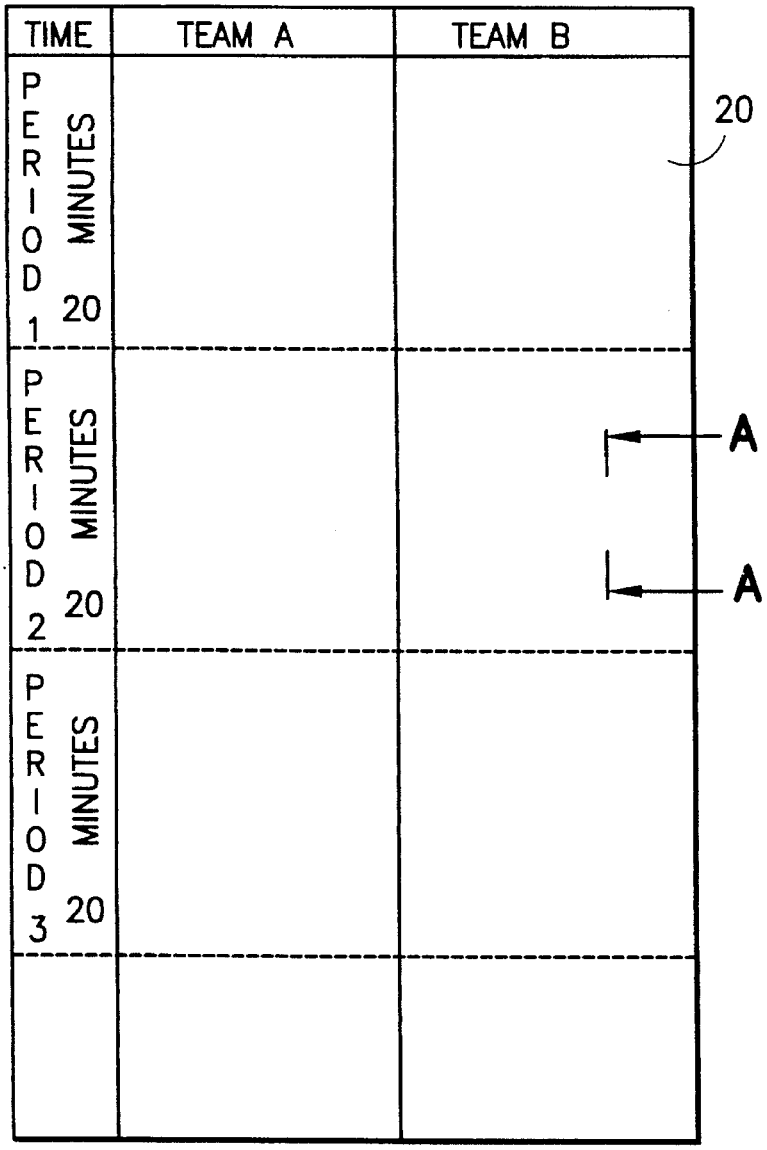
FIG. 1 shows a plan view of a typical timing sheet, prior to use.

Referring now to FIG. 1, there will be seen a typical timing sheet or chart 20, prior to being used. On its ordinate, as seen in this Fig., there are shown periods of the game, i.e. periods into which the same has been subdivided, while on its abscissa, there may be shown two columns, for teams normally opposing one another, such as teams A and B, when that chart is in use.

Figure 2:
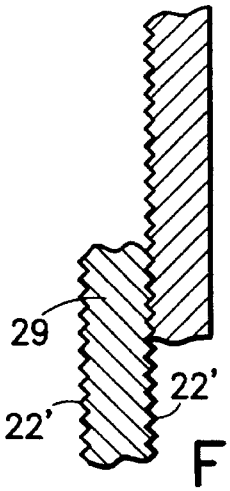
FIG. 2 is a fragmentary cross-section of the timing chart of FIG. 1, which is engaged with a cross-section of a representative tape, according to the present invention.

FIG. 2 shows a cross-section of the chart 20, where its front surface is shown to be formed with a plurality of ridges 22. Mating with the ridges 22 is a special tape 29, formed with ridges 22' on each side, which mate with the ridges 22 on the front surface of the timing chart 20, though only one set of ridges 22' mate with other ridges 22 at a given time.

Figure 3:
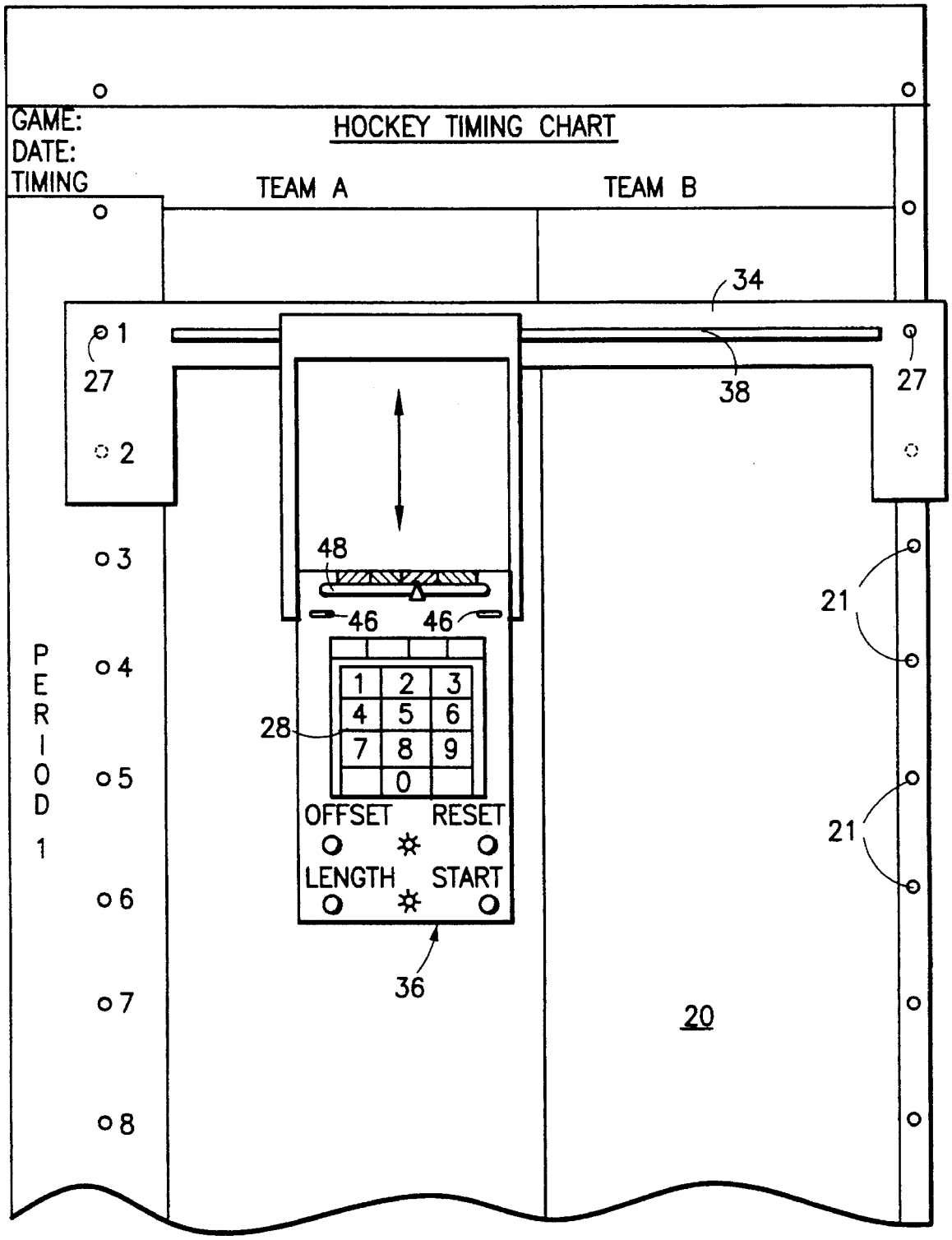
FIG. 3 is a fragmentary plan view of the apparatus, according to the present invention.
Figure 4:
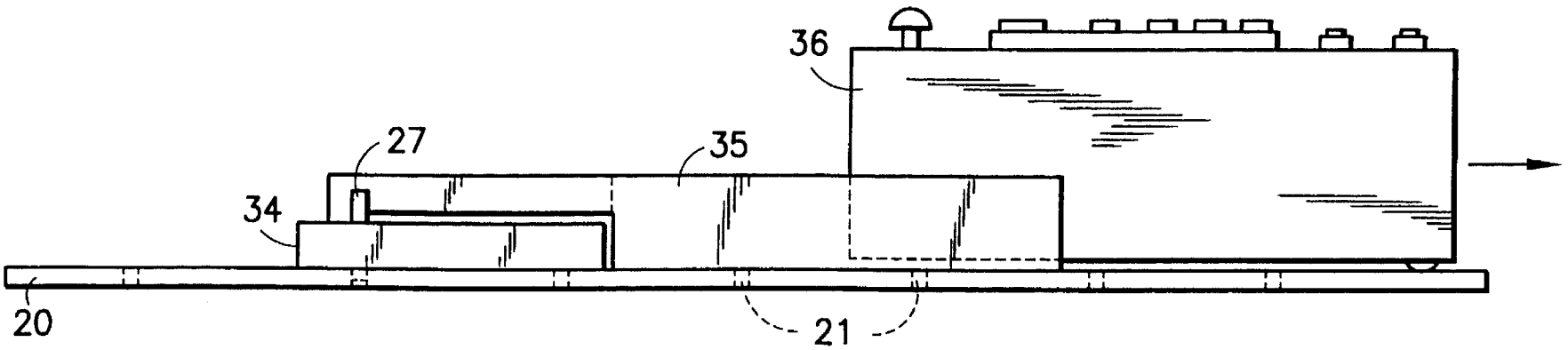
FIG. 4 is a sideview of the arrangement shown in FIG. 3.

FIG. 3 is a fragmentary plan view of the apparatus, with its cover on, according to the present invention, while FIG. 4 is a side view of the apparatus, as already shown in the fragmentary plan view in the FIG. 3. To the timing chart 20 there will be seen attached a mounting or alignment frame 34. Holes 21 are provided at both ordinates of the timing chart 20 at periodic intervals, corresponding in real time to intervals of one sec. Corresponding bores 21' are provided in the mounting or alignment frame 34, and the mounting or alignment frame 34 is attached to the timing chart 20 by means of pegs 27 at integral minutes lines. Near the top of FIG. 3 there is shown a U-shaped attachment and alignment bar 38, also mounted on the mounting and alignment frame 34. Outer members 44 of the U-shaped bar 38 are not visible, since they are mounted within the alignment frame 34 in such a fashion as to permit the U-shaped bar 38 to be spaced from the mounting and alignment frame 34. Members 40 pointing away from a first (horizontally movable) travel frame 35 are joined by a horizontally extending member 41' to complete the U-shaped first travel frame 35. A second travel frame 36 is nestled within the members 40, and is slidably arranged within the first travel frame 35.

The member 41' of the first travel frame 34 is provided with a (non-illustrated) bore, so that the alignment bar or rail 38 can pass therethrough, so as to make the first travel frame 35 slidable on the bar 38.

The second travel frame 36 is provided with tape dispensing control means, such as a key pad 28, on which there are arranged 10 numeric keys denoted from "0" to "9". Also arranged on the second travel frame 35 is a miniature display 32.

A plurality of function buttons 30' to 30"" are also arranged on the second travel frame 36, provided with corresponding display lights 37' to 37"" disposed next to the corresponding function buttons. (Please note that for the sake of clarity only key representative buttons have been shown, so as not to "overload" the drawing.) Above the miniature display 32, as seen in FIG. 3, there are arranged tape selection means, such as a tape selector mechanism, of which only a longitudinal slot 48, and a tape selector knob 45 movable therein are shown, which items will be discussed later. Downwards of the longitudinal slot 48 "marking means" in the form of two additional and smaller "marking slots" 46 are provided.

Through the latter it is possible to mark-up the longitudinal timing chart 20 by means of marking instruments, such as a pencil or a pen, when the carriage is suitably positioned on the timing chart 20.

Figure 3A:
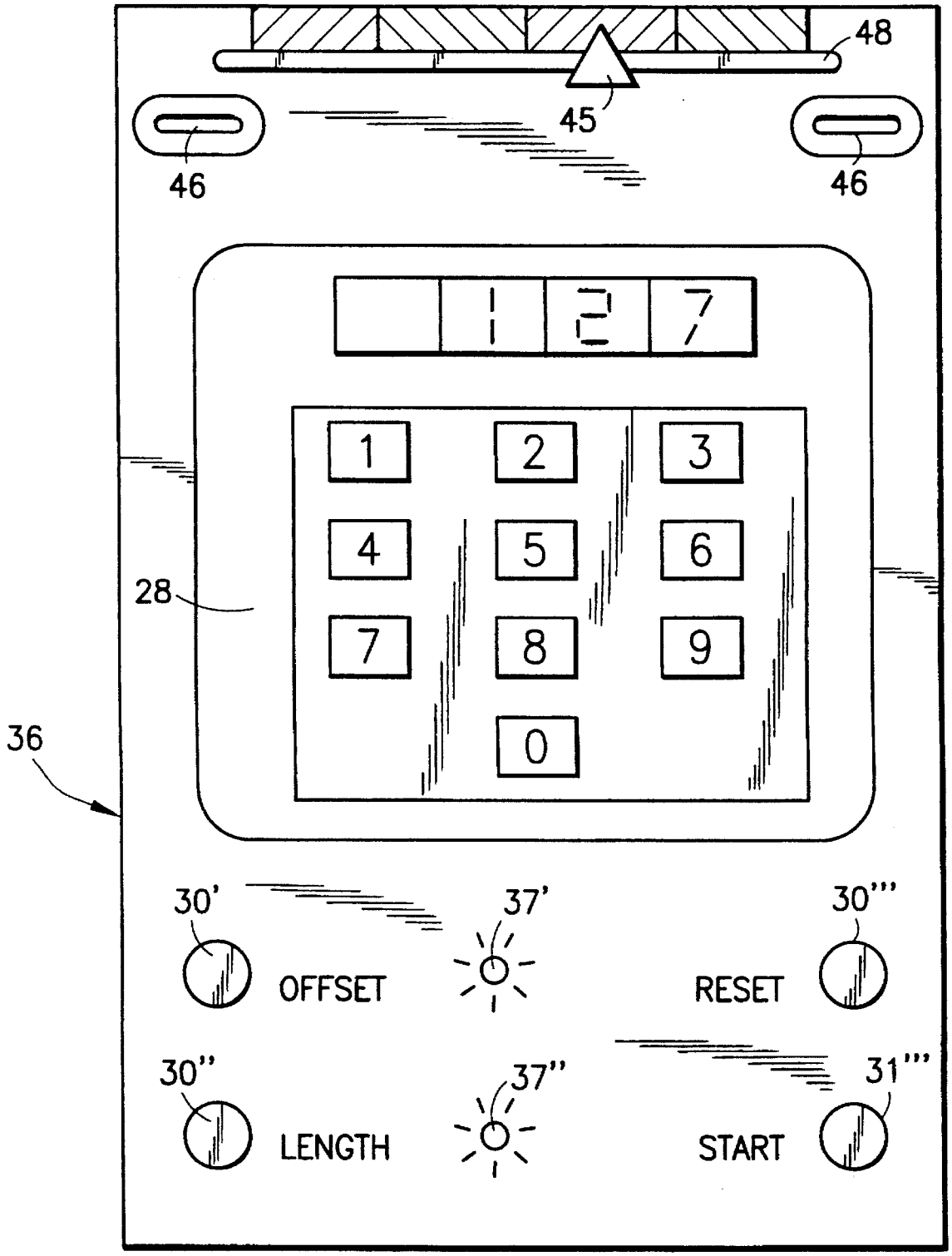
FIG. 3A is an enlarged view of FIG. 3.

FIG. 3A is an enlarged view of FIG. 3, while FIG. 4A is a general sideview of the arrangement shown in FIG. 3, but also showing the relative locations of the two travel frame, and of the attachment and alignment frame, according to the present invention.

Figure 5:
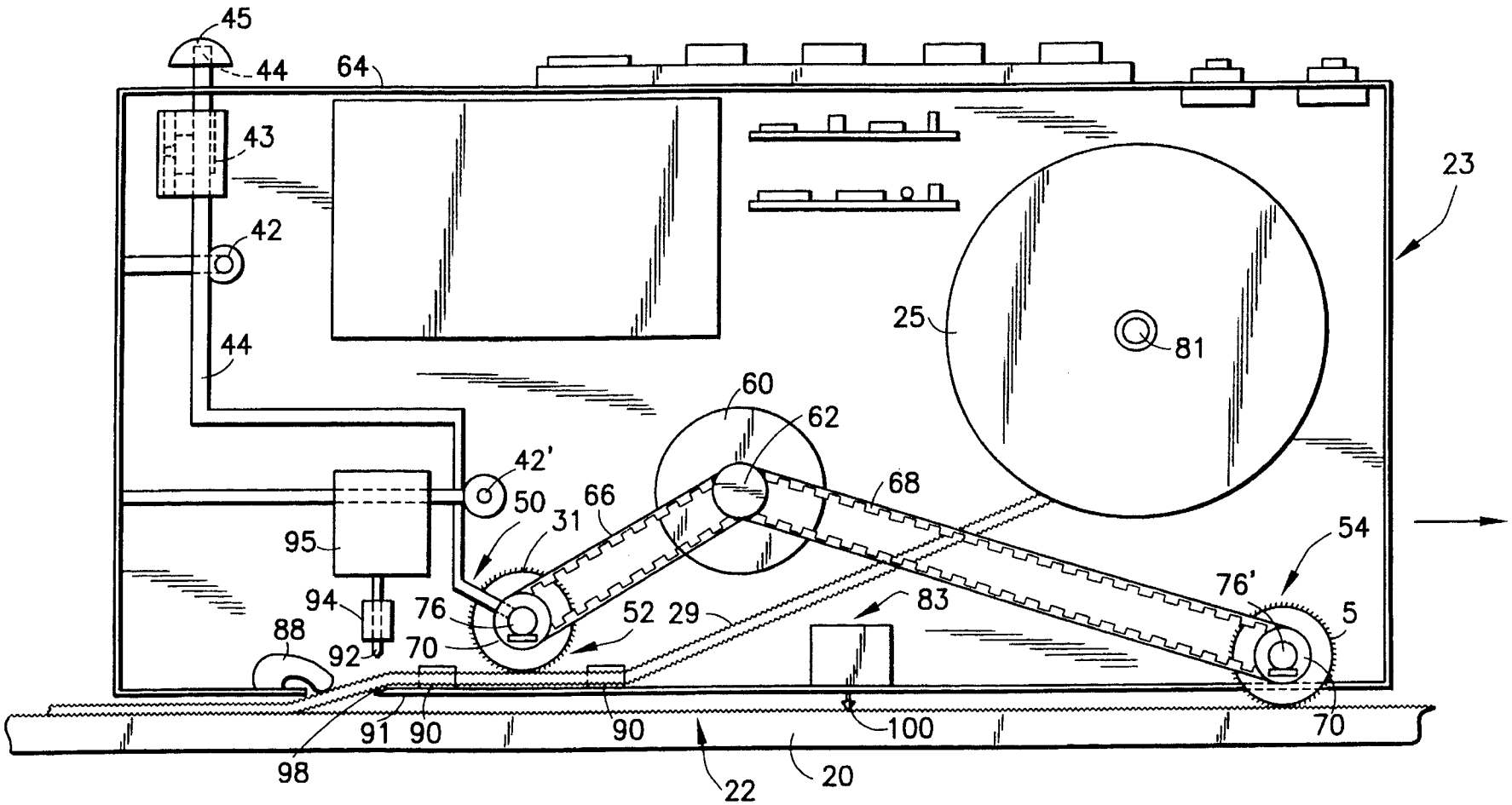
FIG. 5 is a close up side view of the arrangement shown in FIG. 4.

FIG. 5 is also a sideview of the apparatus, according to the present invention, but with its side cover removed. From FIG. 6, described later, it will be seen that the arms 102, form guide means 50 in the form of a fork or U-shaped bracket.

That fork partly encircles the tape dispensing wheel 31. From guide means 50 the assembly leads to a vertically ascending and bent tape-selection shaft 44 and therefrom to a shifter guide 43. The shifter guide 43, as seen in FIG. 5, is secured to the frame 64 of the carriage, and is provided with detents. The shaft 44 ends up in a free end capped with a tape selector knob 45. Linear bearings 42 and 42' urge the tape selection shaft 44 leftwards, i.e. towards the carriage frame 64, so that the tape moving shaft 44, when moved by its top knob 45 within the longitudinal slot 46 (shaft 44 pointing here into the paper, or outward therefrom) leftward or rightward, and towards and into a selected indent 49 extending at right angles thereto, tends to stay there, until the reel or tape selection knob 45 is shifted again to another tape 33. Selection of a tape is accomplished by tape selection means, namely by the afore-described guide means 50. Each of the arms 102 is provided with a polygonal, preferably square hole or opening 104, through which there passes a generally polygonal, and preferably square and stationary reel-moving shaft 56.

It will be seen that the tape dispenser wheel 31, formed with ridges equivalent to those in a representative tape 29, will engage a representative tape reel 33, even when shifted on its usually square reel-moving shaft 56. (While the reel moving shaft 56 is square, its continuation 76, beyond the fork-carrying portion, is round.)

The aligned arms 102 can horizontally slide, as best seen in the following FIG. 6, on the reel-moving shaft 56, and are additionally supported by a generally stationary support-shaft 55. The gear wheel 31 can then be positioned opposite a selected one of the reels 33'—33"" by operating the tape selecting knob 45.

Figure 6:
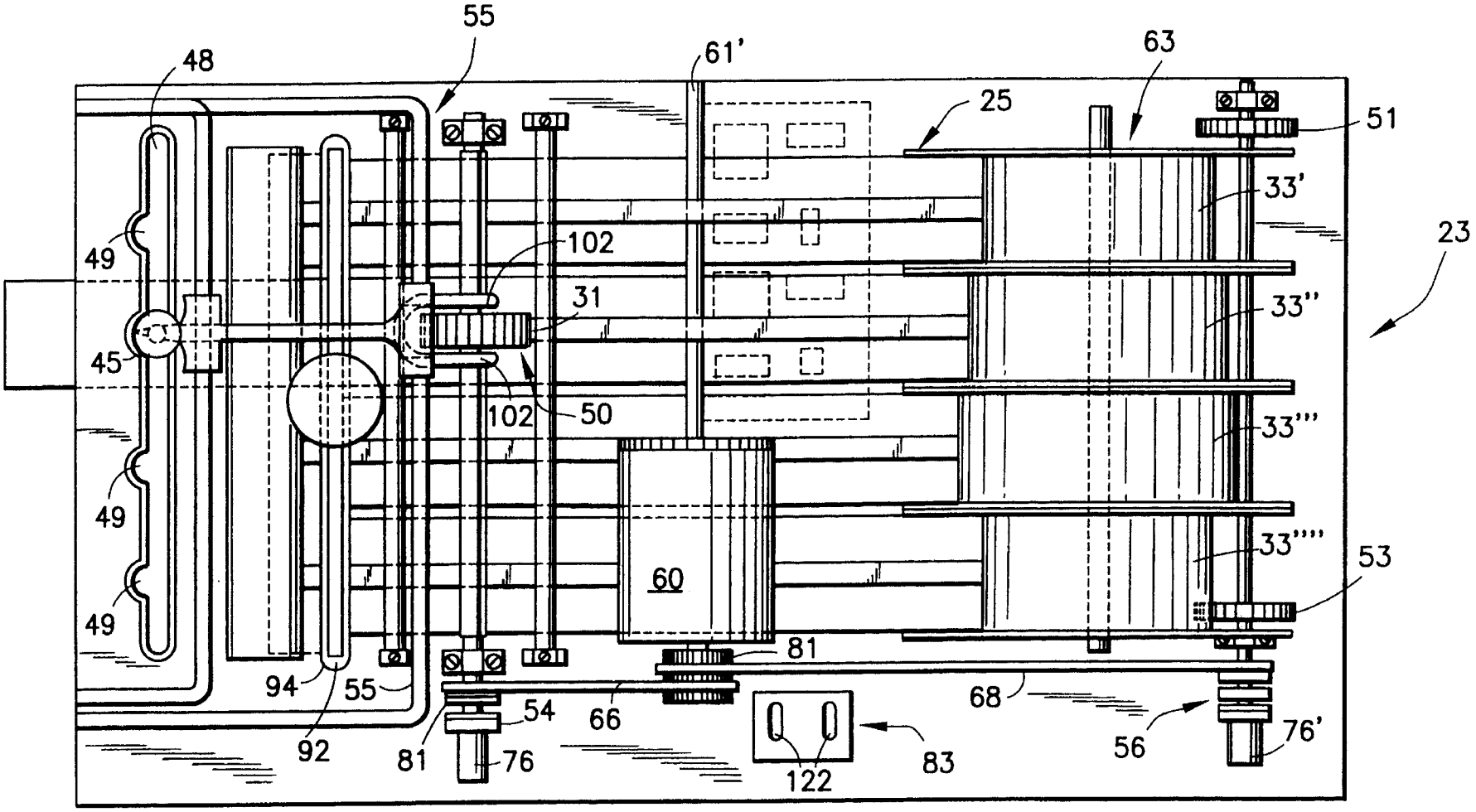
FIG. 6 is a plan view of a longitudinal carriage, and corresponds to FIG. 1, but with its top cover removed.

FIG. 6 then is a plan view of the present invention, but with its top cover removed. It will be seen to contain a longitudinal carriage 23, with its top cover removed, carrying tape dispensing means, such as reel holder 63, on which there is located the tape-dispenser 25 adapted, in turn, to carry a plurality of tape reels 33' to 33"", and other equipment.

It will be seen that the tape dispenser wheel 31, formed with ridges equivalent to those in a representative tape 33, will engage a representative tape 29, even when shifted on its usually square reel-moving shaft 56.

The additional equipment is primarily converting means, or converting apparatus, for obtaining the intermediate data from the statistical data. These are the tape holding means, such as a tape holder 25, so that its center axis or axle is positioned in parallel with the second axis of the timing chart 20.

The tape holder 25, is, in turn, adapted for carrying at least the already mentioned tape reels 33' to 33"". The latter carry corresponding tapes 29' to 29''', which are differently identifiable, respectively, such as by separate colors.

Also provided are tape unrolling means, wherein a representative tape 29 (embodying, for this example, one of the tapes 29' to 29''''), moves in translation, so as to unwind that tape 29 from a representative reel 33. The representative tape 29, in turn, is driven by reel coupling means, such a as toothed wheel 31 in engagement with the representative tape 29. The tape dispensing or translatory moving wheel may be, for example, located on the same shaft as one clutch/brake, i.e. on shaft 76.

The tape dispensing or moving means, as has already been outlined, is preferably implemented as a toothed wheel or gear wheel 31 having ridges 22, in contact with corresponding ridges 22' of a selected (representative) tape 33. The gear wheel 31 therefore has ridges, or teeth, designed to mesh with other ridges on the tape 29; it is, in turn driven by an endless chain or belt 66, which is in operative contact with a pulley 81 of an electric motor 60, having a shaft 61'.

Upstream of the tape dispensing wheel 31 there are provided second tape guiding means, such as tape guides in the form of brackets 90, so that the tape 29 is guided along its path along the floor of the carriage 25 without curling upwardly.

Further downstream there is provided an exit slot 98 in the floor of the carriage, so that the tape 29 can pass therethrough in an orderly manner.

The exit slot 98 is bordered upstream by a wedge 91, permitting the tape 29 to slope downwardly. Further downstream, and beyond the exit slot 98 there are provided tape restraining means, such as an elastomeric pressure pad 88, whose task it is to prevent the tape 29 from passing through the exit slot 98 in an upwardly direction. Above the exit slot 98 there are provided cutter means, including blade guide means 91, which houses the solenoid 70, and therebelow a blade guide 94 as well as a retractable blade 92, which latter includes the cutting means, i.e. it serves to cut off a predetermined length of the tape 29. The blade 92 is command-actuated. Adhesive means are also provided, i.e. the tape 29 with its ridges 22' is then shifted onto the timing chart 20.

Thus its ridges 20 mate with the ridges 22' on the tape 29, and stay put, thus implementing both the aforesaid adhesive means, and the engagement means between the timing chart 20 and the tape unrolling means.

Upstream of the exit slot 98, below the representative tape 29, provision is made for a transducer assembly 83, mounted on the floor of the carriage, which includes a stylus 100, making in turn contact with the tape 29 passing therebelow, and is feeding a piezo- or magnetic-transducer 102, which is, in turn, followed by a pulse shaper 114.

As can be seen from FIG. 5, the transducer assembly 83 is provided at its output with two slots 122, serving as a nonconducting receptacle. Still further upstream beyond the transducer 83, and still below the representative tape 29, there is provided a pair of drive wheels 51 and 53, which wheels come into play when either the OFFSET or LENGTH mode operations are selected.

Figure 6A:
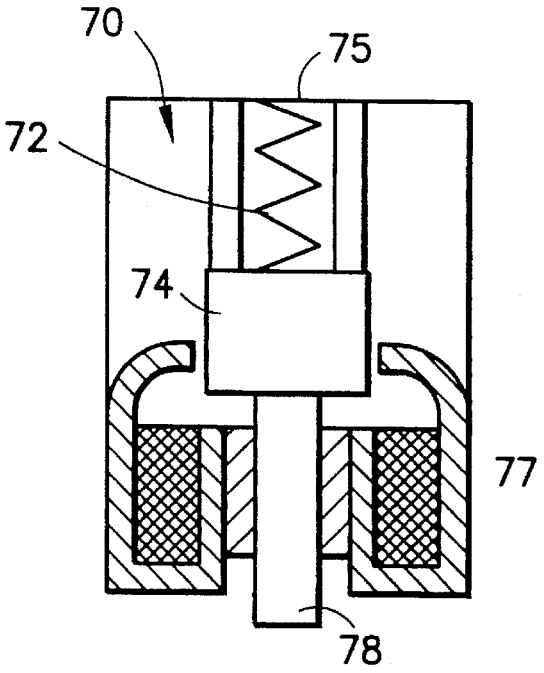
FIGS. 6A and 6B show a cross-section of a de-activated, and activated solenoid, respectively.
Figure 6B:
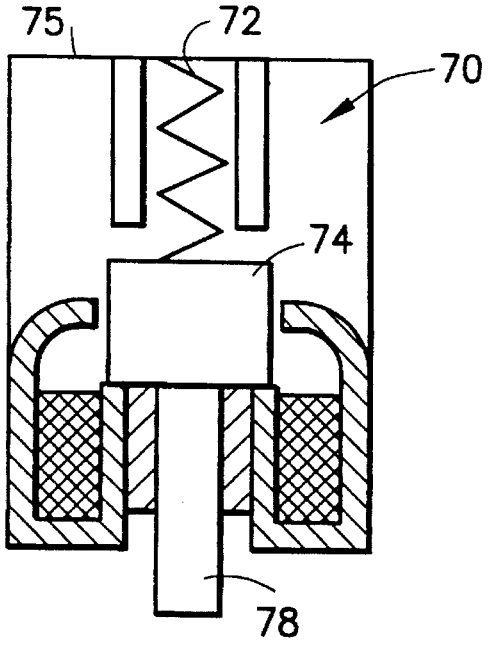

FIGS. 6A and 6B show a cross-section of deactivated, and activated solenoids, respectively. A plunger/shaft 78 is normally, in the deactivated state of the solenoid 70, held back by a restrainer spring 72 secured between the soft-iron armature 74 and the solenoid-housing 71.

When the solenoid 70 is activated, an electro-magnetic coil 77 urges the solenoid 70 to make contact therewith, so as to extend the plunger/shaft 78 outwardly.

Figure 7:
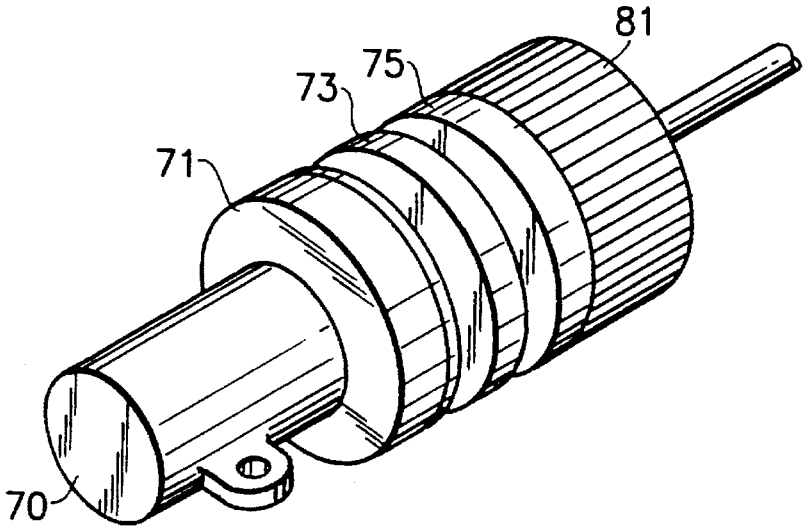
FIG. 7 is an isometric view of a clutch/brake.
Figure 8:
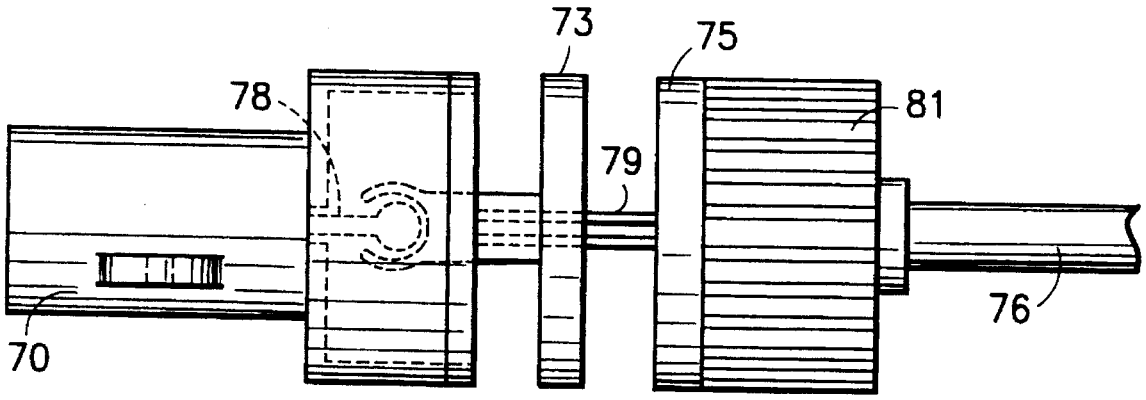
FIG. 8 is a left side view of the clutch/brake of FIG. 7.
Figure 9:
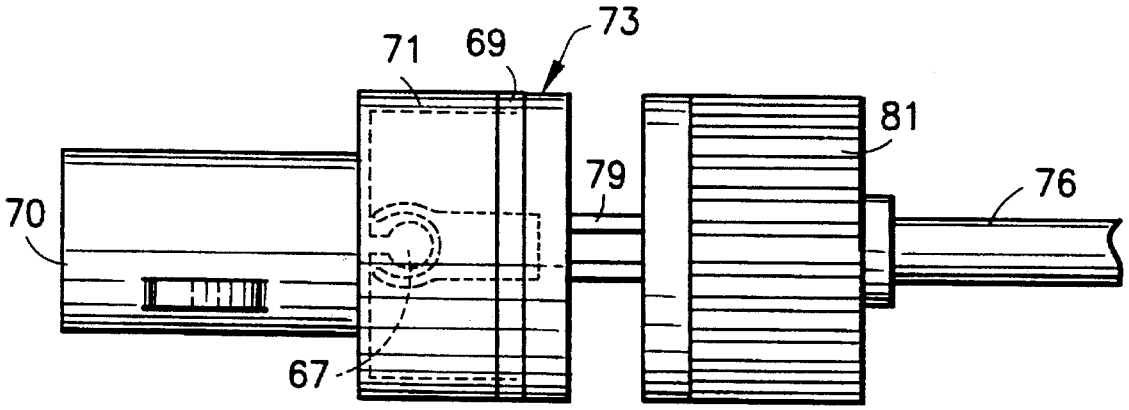
FIG. 9 is a schematic view of the clutch/brake of FIGS. 7 & 8, with the driving solenoid energized.
Figure 10:
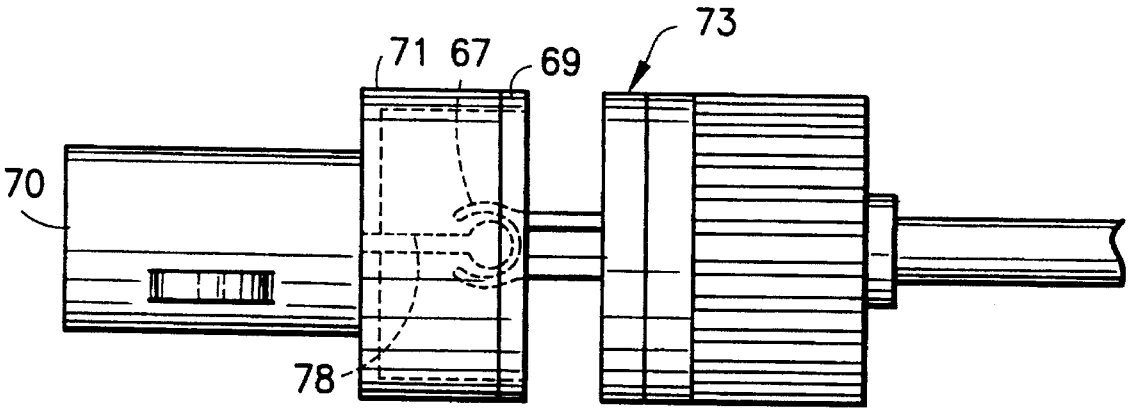
FIG. 10 is a schematic view of the clutch/brake of FIGS. 7 & 8, with the driving solenoid de-energized.

The solenoid 70 is corporated into electromagnetic clutch means, and respective parts of electromagnetic clutch/brake means are shown in FIGS. 7 and 8, while the operation of a typical clutch/brake is clearly illustrated in FIGS. 9 and 10. FIG. 9 shows a clutch brake with the drive solenoid de-energized while FIG. 10 shows it with the solenoid energized.

A typical clutch/brake is composed, as shown in FIGS. 9 and 10, of a solenoid 70 having a retractable plunger/shaft 78 with a splined shaft 79 extending therefrom outwardly. The plunger/shaft 79, in its energized mode, is encircled by a cylindrical housing 71 rigid with the solenoid 70, followed by a first abutment disk 69, which has an end friction surface 80 facing away from the solenoid 70.

The first abutment disk 69 is followed, in turn, by a brake/clutch disk 73, which also has a splined bore, so that it can only slide on the splined shaft portion 79. Each lateral side of the brake/clutch disk 73 has a friction clutch surface, and the brake/clutch disk 73 is followed by a second abutment disk 84, which generally corresponds to the first abutment disk 69, but which has a smooth bore, so as to be rotatable on the shaft portion 79. An end surface thereof, facing away from the solenoid, is then followed, in turn, by a timing-belt pulley 81, locked, when the clutch is engaged, with the second abutment disk 74, which has, in turn, in that mode, a drivable shaft 76.

When the solenoid 70 is energized, the brake/clutch disk 75 is forced to be in contact with the timing belt pulley 31, and it is therefore engaged, so as to drive the output shaft 76; when, however, the solenoid 70 is de-energized, the brake/clutch disk 73 is forced against the friction surface of the first abutment disk 69, and the pulley 31 is free-wheeling; as shown in FIGS. 5 and 6, a clutch/brake is used in two places. One location is to couple power from the gear motor 60 to the drive shaft 76', and the other location is to couple power from the same gear motor 60 to the shaft 76 coupled to the tape dispensing wheel 31. In an alternate embodiment the two abutment disks can be omitted, provided that suitable replacement friction surfaces are provided on the components adjoining the brake/clutch disk 75, an end surface of the solenoid 70, and an end surface of the timing belt pulley facing the solenoid. The gear motor 60 is coupled to the clutch/brakes 52, 54 via timing belts 66, as can be seen from FIGS. 5 and 6. The operation of the tape dispensing unit 25 requires that either the drive wheels 51 and 53 are powered, while the tape dispensing wheel 31 is stationary (i.e. Offset mode), or that the drive wheels 51 and 53 are powered in synchronism with the tape dispensing wheel 31 (i.e. Length mode). Since this action is under micro-controller control (see FIG. 14), an electronically controllable clutch is operationally required to selectively engage the tape dispensing wheel 31. A clutch, however, is not operationally required on the drive wheel shaft, since the drive wheels are energized in either mode.

Consideration of the insidious effects of inertia, however, dictate either an elaborate speed control to slow the motor 60, when approaching a destination, or the introduction of an electronically controlled brake, large enough to quickly dissipate the considerable rotation inertia.

A third and better solution, i.e. the one adopted here, uses identical clutch/brakes as interfaces between the gear motor drive and both the shaft 76 driving the drive wheels, and the shaft driving the tape dispensing wheel.

An almost instantaneous stop is required when the destination is reached to limit overshoot to less that one half a unit timing step. This is achieved on both axles by first of all selecting a relatively slow speed of motion and tape dispensing for the tape dispenser.

The speed is limited to 25 mm/sec or less by a judicious choice of gear reduction in the gear motor 60. Thus the linear inertia of the tape dispenser is minimal, even though its weight is substantial. By using lightweight drive wheels, the inertia of the drive wheel/drive wheel shaft is kept low. The inertia of the motor armature and gear train, along with the timing belts and pulleys, however, is substantial. If clutches can be used to isolate these elements from the shafts driven by them in a small instant of time—a few milliseconds—the high inertia components can slowly coast to a stop.

The inertial energy is dissipated in component friction, while having no effect on the driven shaft or shafts.

But if the clutch can also serve as a brake, which is applied to the attached shaft at the same moment as it isolates the shaft from the drive, the low inertial energy of the shaft and its attachments is very quickly dissipated in even a small brake element. This is the operational nature of the clutch/brakes herein described.

A low inertia brake/clutch disk 73 is forced through an abutment disk 75 against the side of the timing belt pulley 61 driving the output shaft 76, when the solenoid is energized. When de-energized, the afore-mentioned restraining spring 75, which is integral with, or is connected to the plunger, shuttles the same brake/clutch disk 73 back a small distance to force it against a stationary friction surface of the abutment disk 69, where inertial energy is converted to heat by virtue of kinetic friction, thus dissipating the inertial energy.

Figure 11:
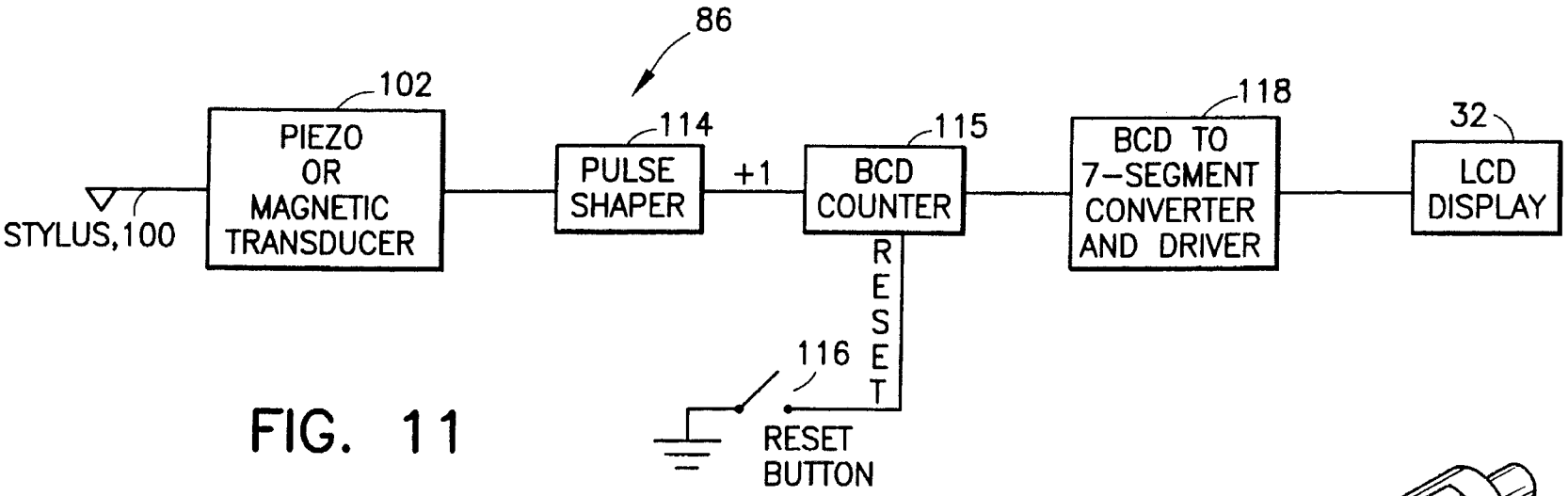
FIG. 11 is a schematic diagram of a length measurement sensor, or digital planimeter, according to the present invention.

Turning now to FIG. 11, that Fig. will be seen to show a block diagram of a digital planimeter. A stylus 100 is its input sensor, followed by a piezo- or magnetic pick-up 102, which is in turn followed by a pulse shaper 114. The latter three items, instead of filling a longitudinal shell or chassis, can alternately be combined to form a stationary transducer 83, which is mounted on the carriage 23, as shown in FIGS. 5 and 6, and which is formed with recesses 122, into which can be plugged the plugs 120, shown in FIG. 12A. A separate output assembly 103, as can again be seen from FIG. 11, includes a BCD counter 115, a grounded reset button or switch 116, one free end of which is connected to a reset lead 105, which, in turn, feeds the counter 115. Upon the reset lead 105 being grounded, the counter 115 is reset to a count zero.

Figure 12:
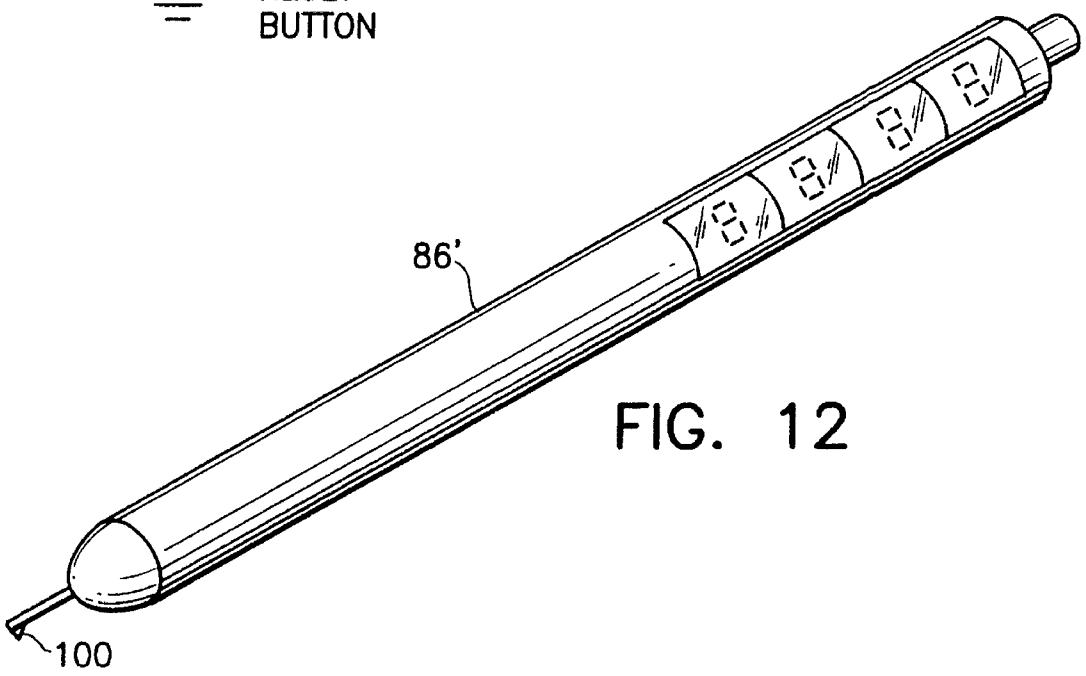
FIG. 12 is a perspective view of the digital planimeter, whose block diagram is shown in FIG. 11.
Figure 12A:
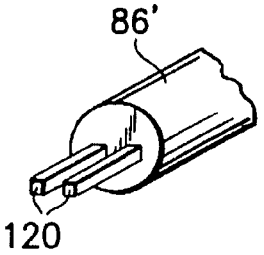
FIG. 12A is a perspective view of a front end of a digital planimeter similar to that of FIG. 12, except that it plugs into a stationary transducer assembly provided in the carriage, according to the invention.

The counter 115 is followed by a BCD 7 segment converter and driver 118, itself fed by the counter 86. The output of the counter 115 feeds the previously mentioned miniature display 32. The outward appearance of the digital planimeter is shown in FIG. 12. The physical shape of the output assembly 86', i.e. a truncated length measurement means, is shown in FIG. 12A, comprising substantially a longitudinal cylinder, which at its input end is fitted with two prongs 122, designed to be plugged into the slots 122 of the stationary transducer assembly 83.

The output assembly 86', when plugged into the transducer assembly 83, then constitutes a fixed length measurement means 86. The output assembly 103 will then be seen to constitute conversion means for changing a previously mobile length measurement means to stationary length measuring means. The aforedescribed length measurement means will pick up only "bumps" with its stylus 100, i.e. the ridges of the tape 29.

Figure 13:
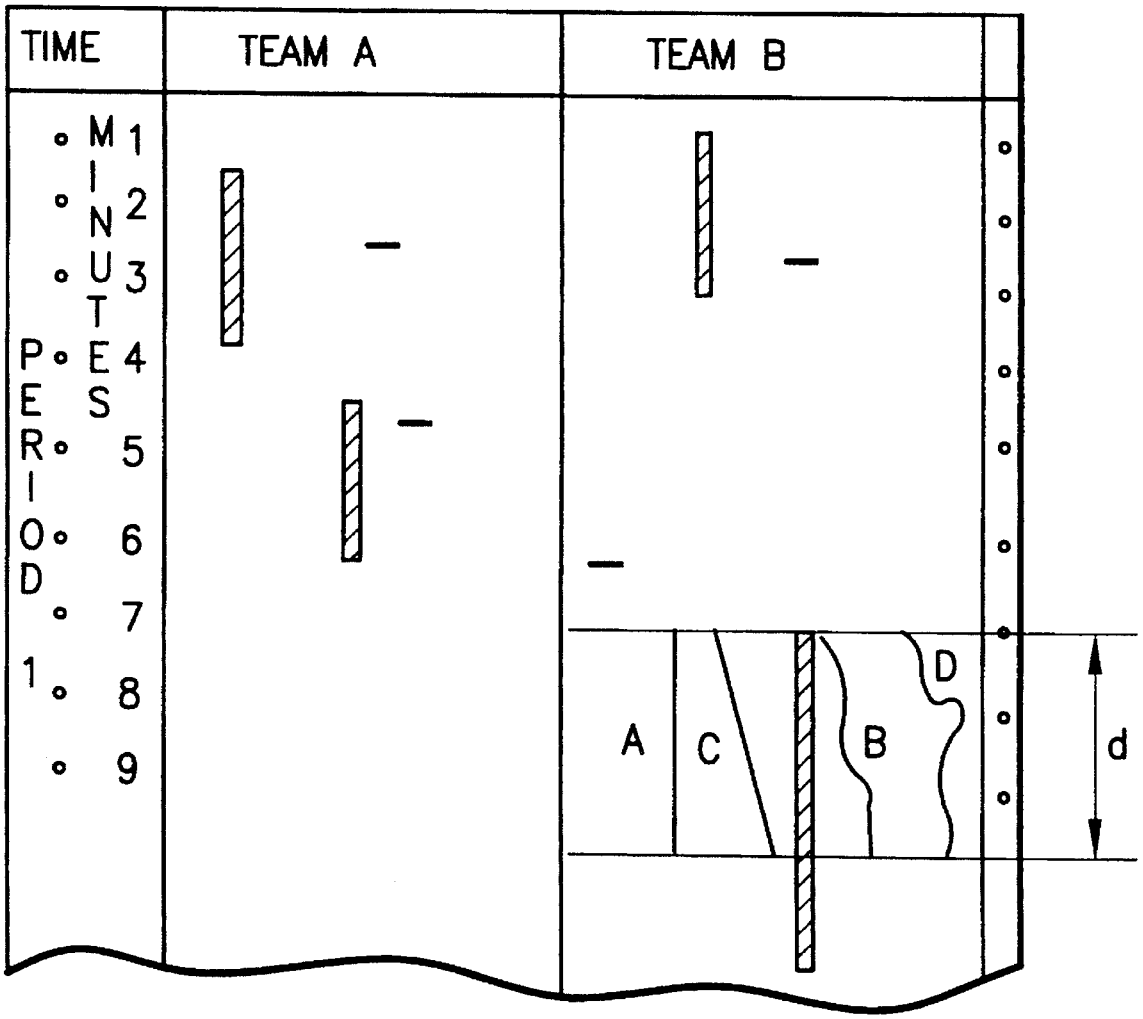
FIG. 13 illustrates the various paths the digital planimeter, according to the present invention, can traverse, without its reading being influenced thereby.

Such a design of length measurement means, i.e. of a digital planimeter, has the advantage particularly noteworthy in this application, that it can generally advance in a forward direction without incurring any change in the length measurement detected. This is illustrated in FIG. 13. Here a distance "d" is measured via paths A, B, C and D. Only path D, which has a reverse position and velocity component would provide a misleading indication.

In operation, the mounting and alignment frame 34 is placed on the timing chart 20 so that its two attachment pegs 27 are inserted into the appropriate holes 21 in the timing chart 20. Next the Starting Point, or first travel frame 35 is slid on the rail 38 of the mounting and alignment frame 34, and shifted to the desired location on the timing chart 20. A second travel frame 36 is then slid between the rails 40 of the first travel frame 35 so as to be moved upwardly. If the operation is simply to make an accurate pen mark, the OFFSET button is pressed, and the OFFSET indicator will light up.

Then the desired number of steps, i.e. seconds, of OFFSET are entered using the keys 30 of the manual keypad 28. (If an error is made, the RESET button is pressed, and the procedure is started again.) When the desired OFFSET appears in the display unit or miniature display 32, the START button is depressed. At this point, the second travel frame will automatically move a distance corresponding to the number of OFFSET steps, i.e. seconds, desired.

Now a pen can be used in one of the side windows or marking slots 46 to make an accurately placed mark on the timing chart 20. If tape were to be dispensed from this OFFSET starting point, the LENGTH KEY would be depressed, and the LENGTH MODE indicator would light.

Now the desired tape length, using the numeric keypad 28 is entered. The shift or tape selection knob 45 is now used to select the desired tape color or reel, and then the START button is again depressed. At this point the second travel frame 36 moves forward the desired amount, while laying down the desired length of tape in the desired location.

Figure 14:
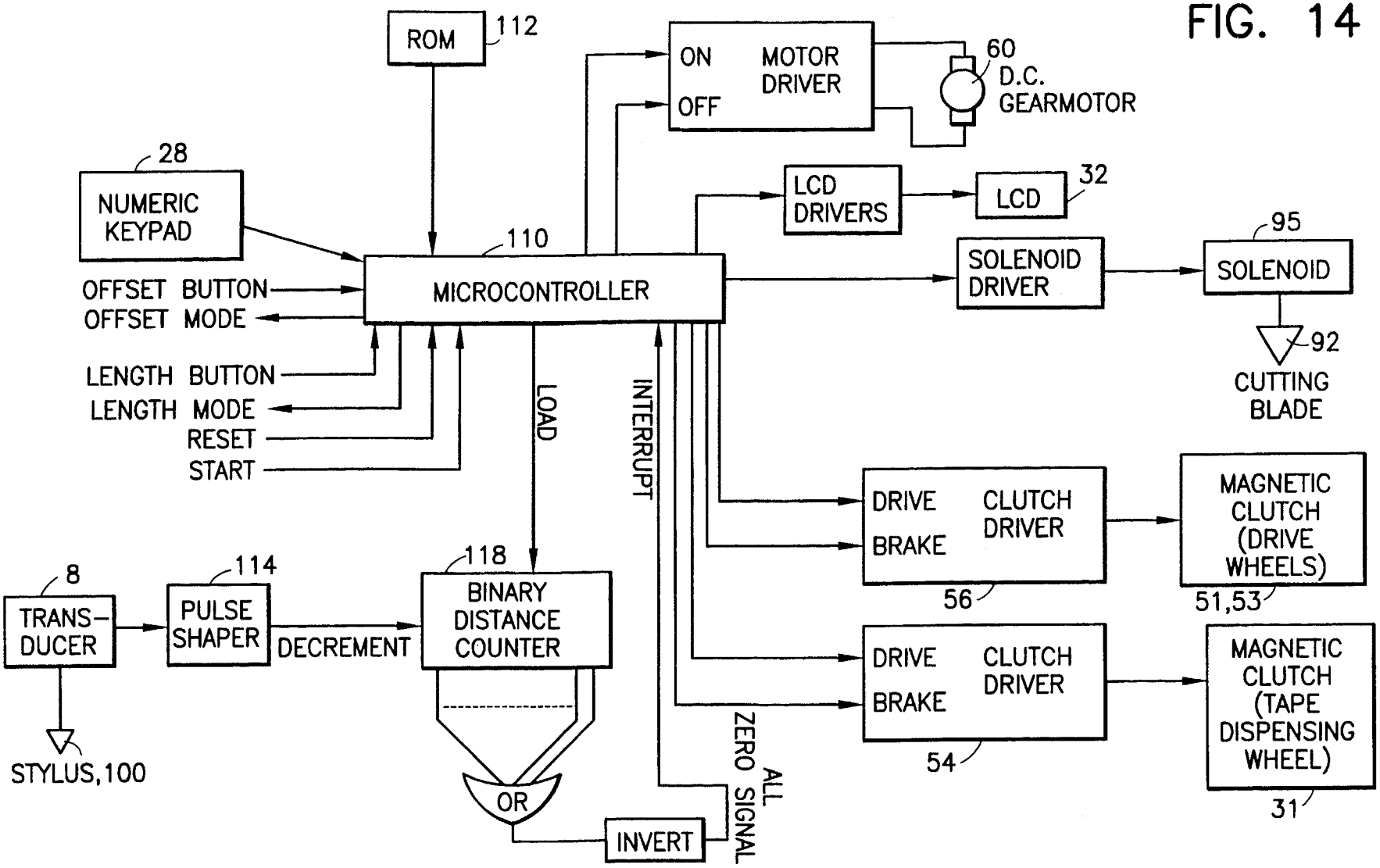
FIG. 14 is a block diagram of the drive and control unit according to the present invention.

FIG. 14 is a block diagram of the drive and control means of the present invention. Its operations are controlled by a micro-controller 110. A read-only memory (ROM) controls its operation according to an OFFSET flow chart, shown in FIG. 15, and according to a LENGTH flow chart, shown in FIG. 16. Reverting to FIG. 14, after the desired OFFSET mode, or LENGTH mode have been selected, they are entered into the numeric keypad 28 by pressing the corresponding buttons.

As in the aforesaid motors the carriage 23 is required to travel to its selected location; in these modes the motor driver stage then drives the D.C. gear motor, until the binary distance counter, which is fed by the transducer making contact with the timing chart, signals via the pulse shaper that in decrementing the count, zero has been reached; this information is passed in decoded form on to the micro-controller via an OR gate and an inserter. Concurrently that information is also fed to the LCD display via the LCD drivers, and to the solenoid via the solenoid driver. The solenoid then acts on the cutting blade 92 for cutting off the tape. During this time the magnetic clutch acting on the tape dispensing wheel 31 has also been activated. When, however, only driving wheels 51 and 53 are to be activated, only the magnetic clutch leading to the drive wheels 51 and 53 is energized.

Figure 15:
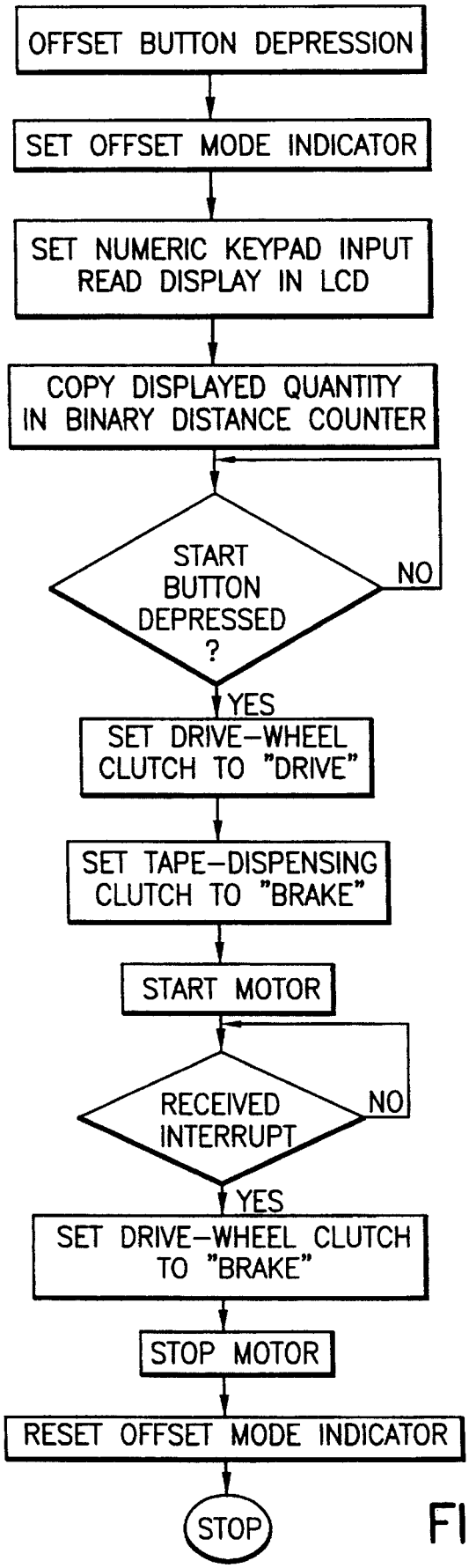
FIG. 15 is a flow chart for the OFFSET mode operation, according to the present invention.

FIG. 15 shows a self explanatory-OFFSET flow chart. First the OFFSET start button is depressed, and the OFFSET indicator set. The numeric keypad is then set, the display in the LCD indicator is read, and copied into the binary distance counter. After the START button is depressed, the drive-wheel clutch is set to zero. (In the event the START button has not been depressed, or is malfunctioning, the device returns its earlier mode.) Subsequently the DRIVE-WHEEL clutch is set to DRIVE, and the TAPE-DISPENSING clutch is set to zero. The motor is started, and if an INTERRUPT signal has been received, the DRIVE-WHEEL clutch is set to BRAKE. The OFFSET indicator is then reset.

Figure 16:
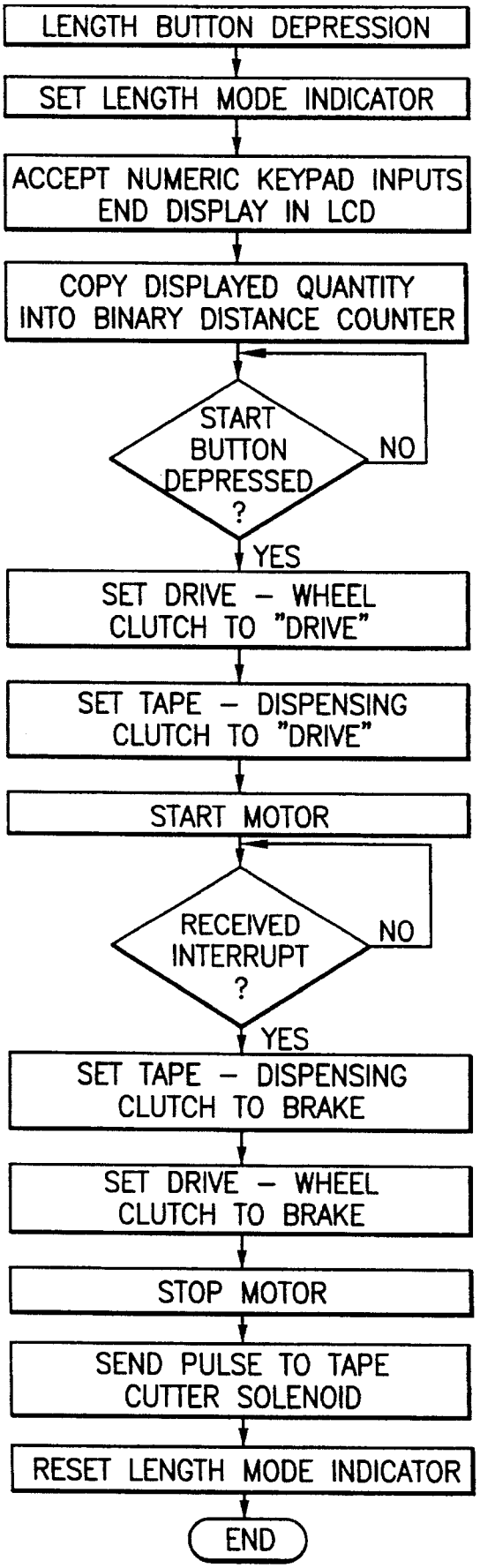
FIG. 16 is a flow chart for the LENGTH mode operation, according to the present invention.

FIG. 16 shows the LENGTH flow chart, which is, in fact, also self-explanatory. Initially the LENGTH start button is depressed, and the LENGTH indicator set. The numeric keypad is then set, and the display in the LCD indicator is read, and copied into the binary distance counter. After the START button is depressed, the DRIVE-WHEEL clutch is set to DRIVE. (in the event the START button has not been depressed, or is malfunctioning, the device returns to the mode in which the binary distance counter is displayed). Subsequently the TAPE-DISPENSING and DRIVE WHEEL clutches are set to BRAKE. The motor is started, and if an INTERRUPT signal has been received, the DRIVE-WHEEL clutch is set to BRAKE, so that the motor is stopped, and a pulse to the TAPE-CUTTER solenoid is sent to start cutting of the tape. The LENGTH indicator is then reset.

Figure 17:
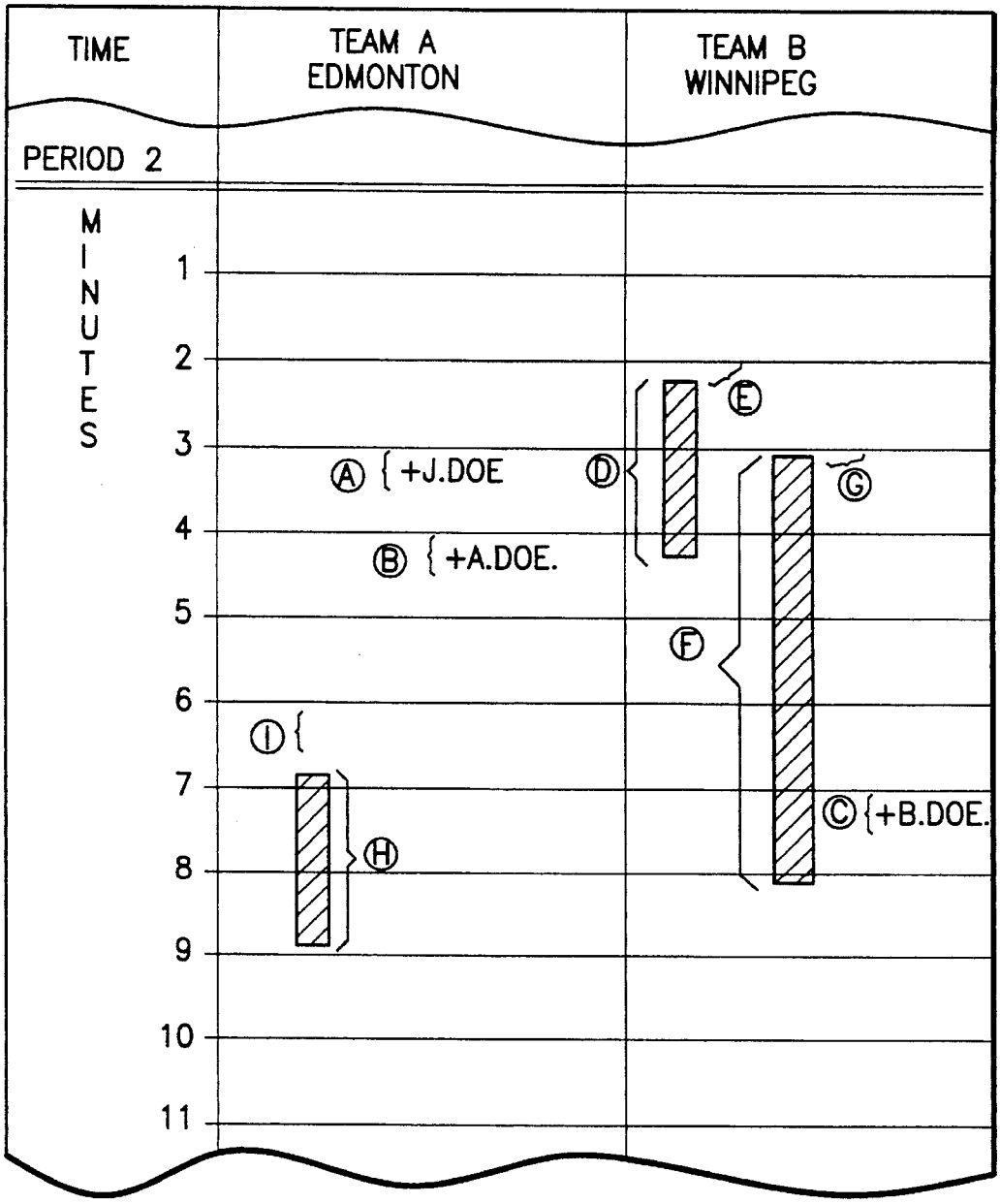
FIG. 17 is a portion of a marked-up timing chart, according to the present invention.
Figure 18:
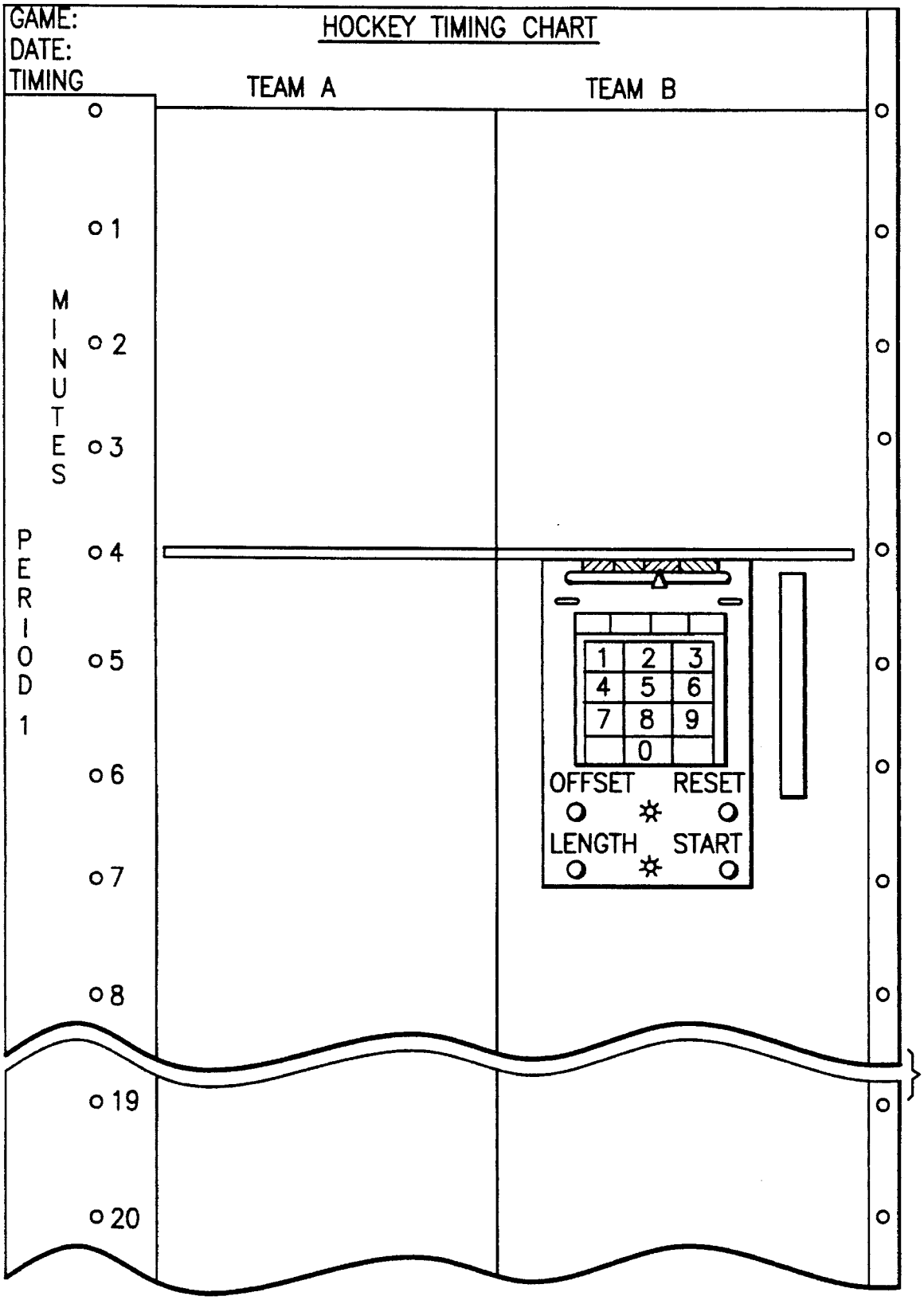
FIGS. 18, 18A, 18B, 18C, 18D and 18E show examples of the apparatus in use, in plan view as in FIG. 3.
Figure 18A:
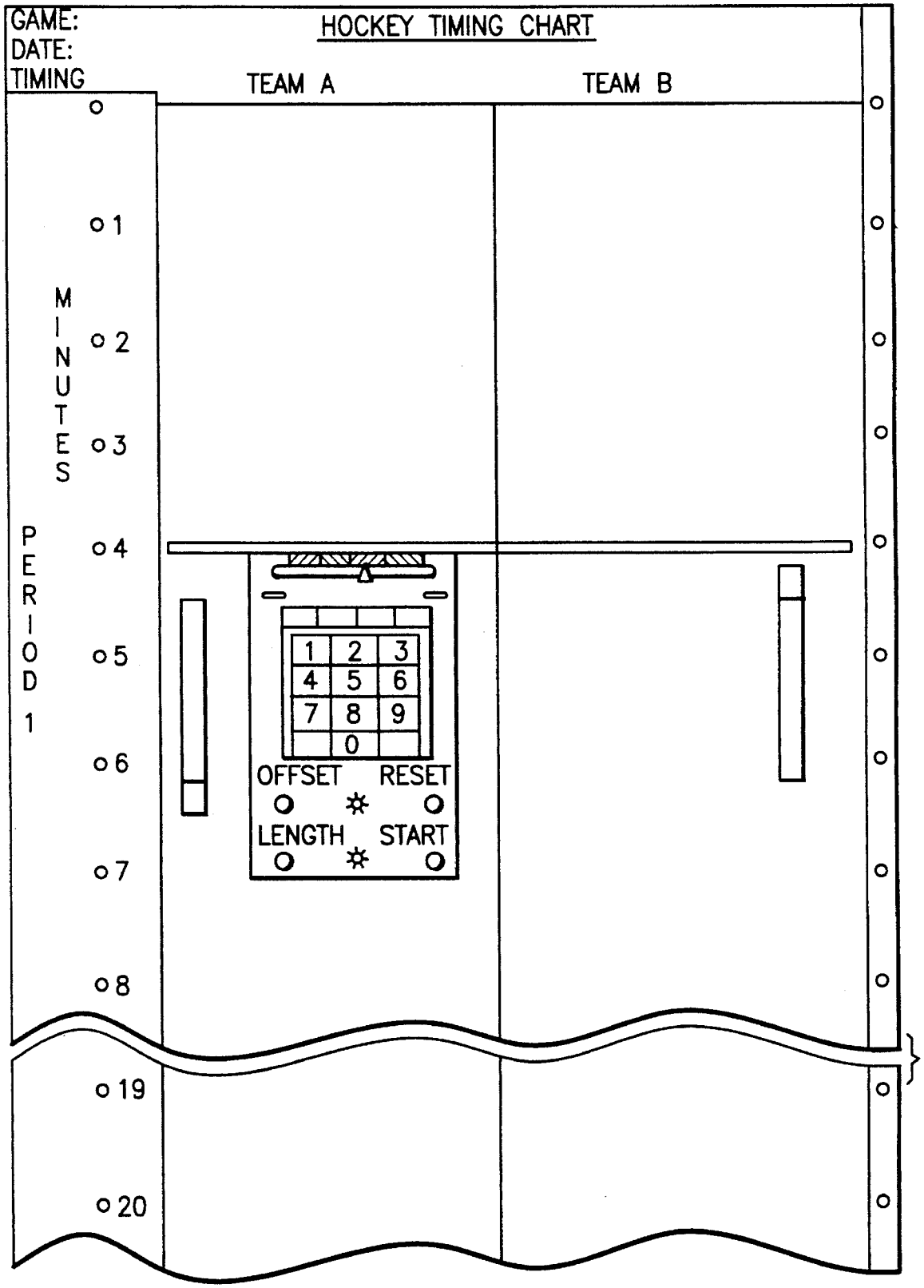
Figure 18B:
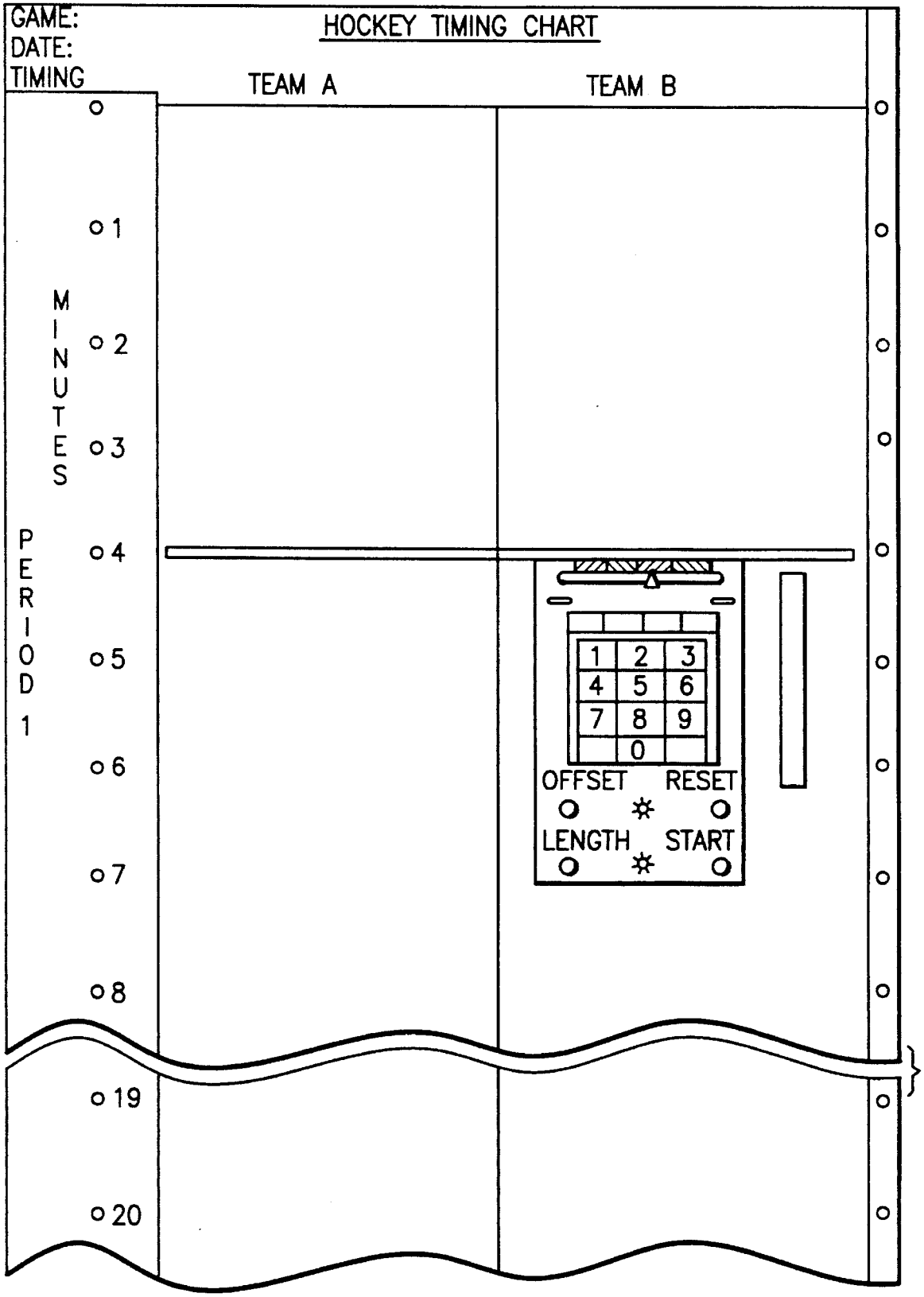
Figure 18C:
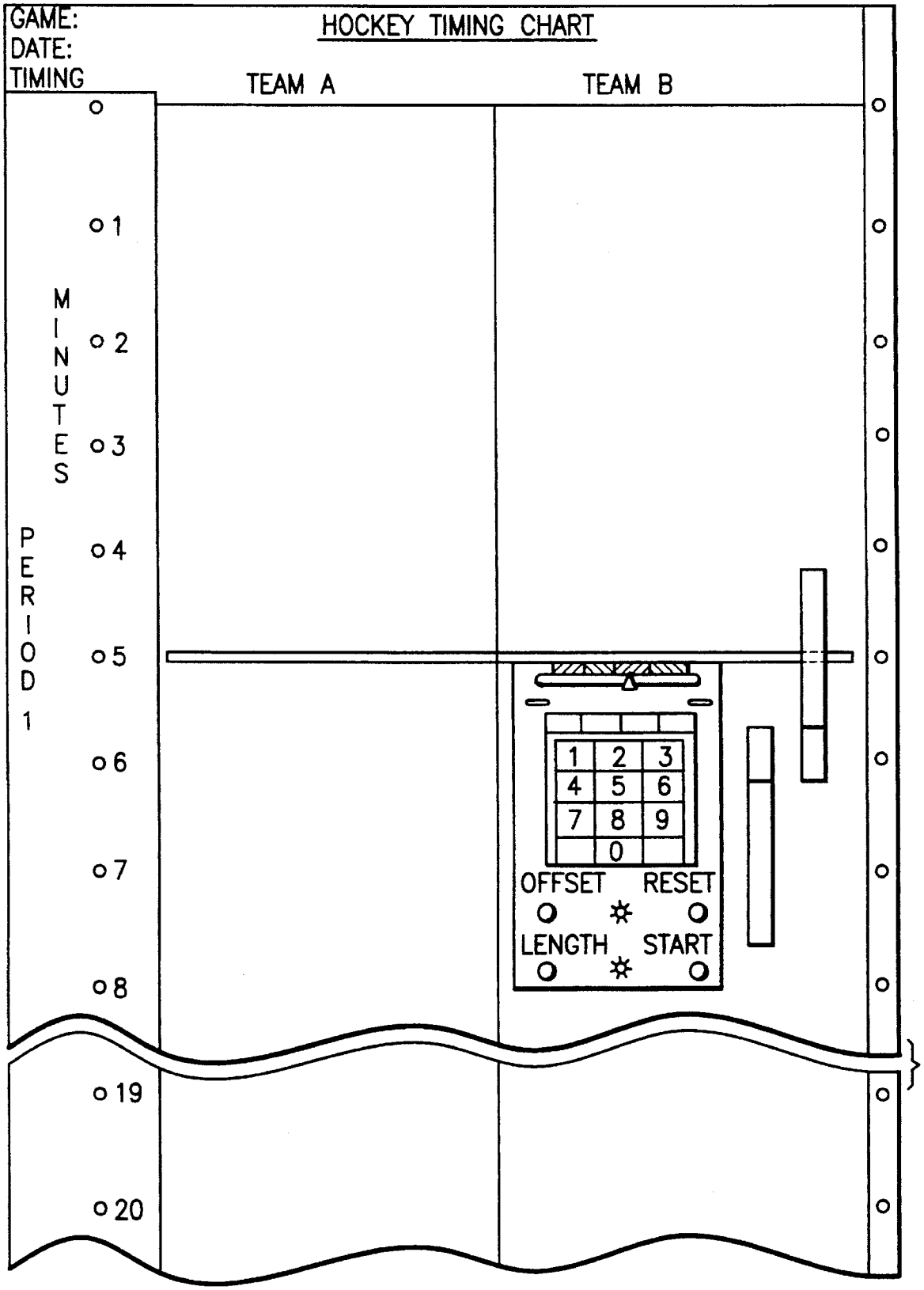
Figure 18D:
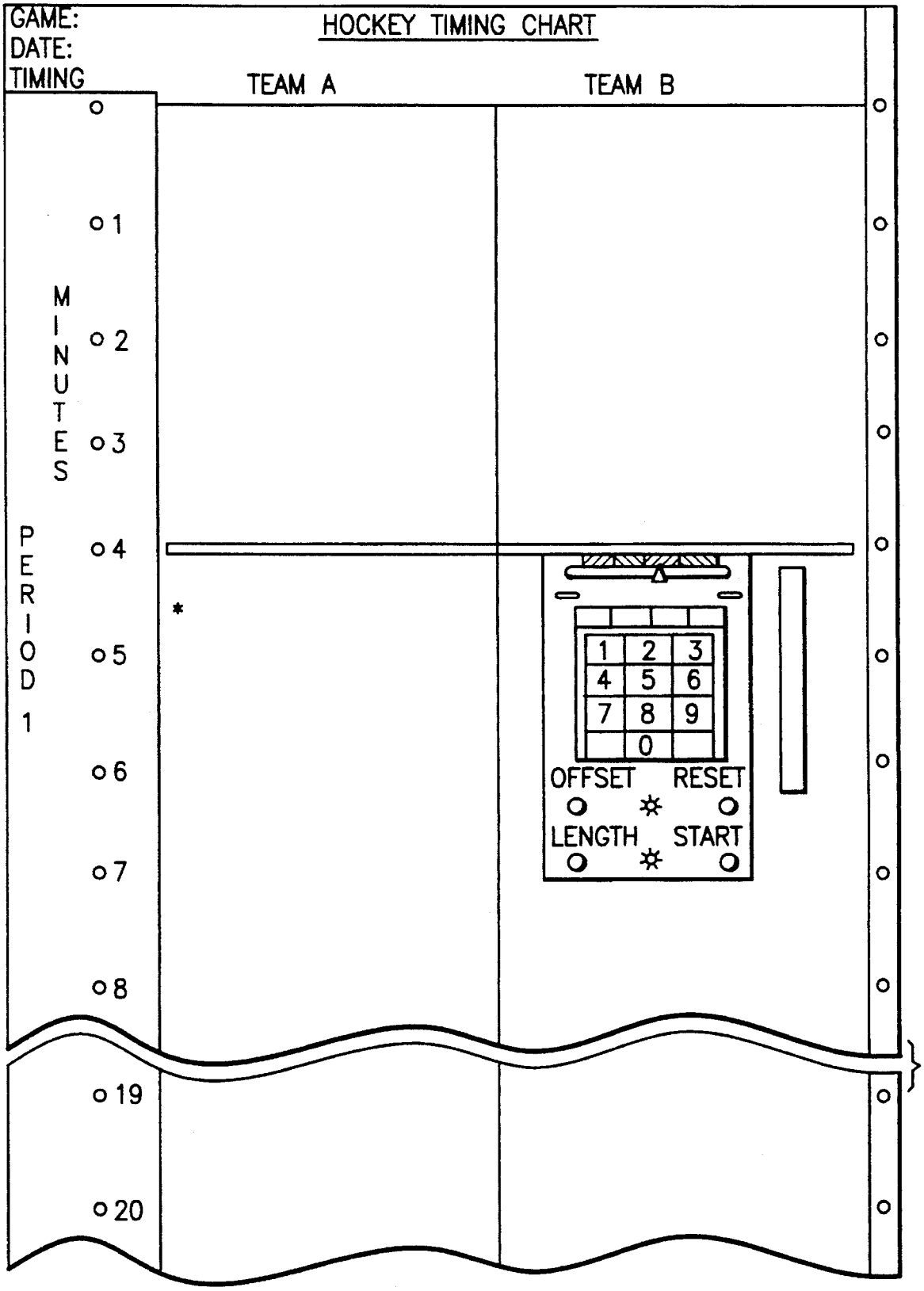
Figure 18E:
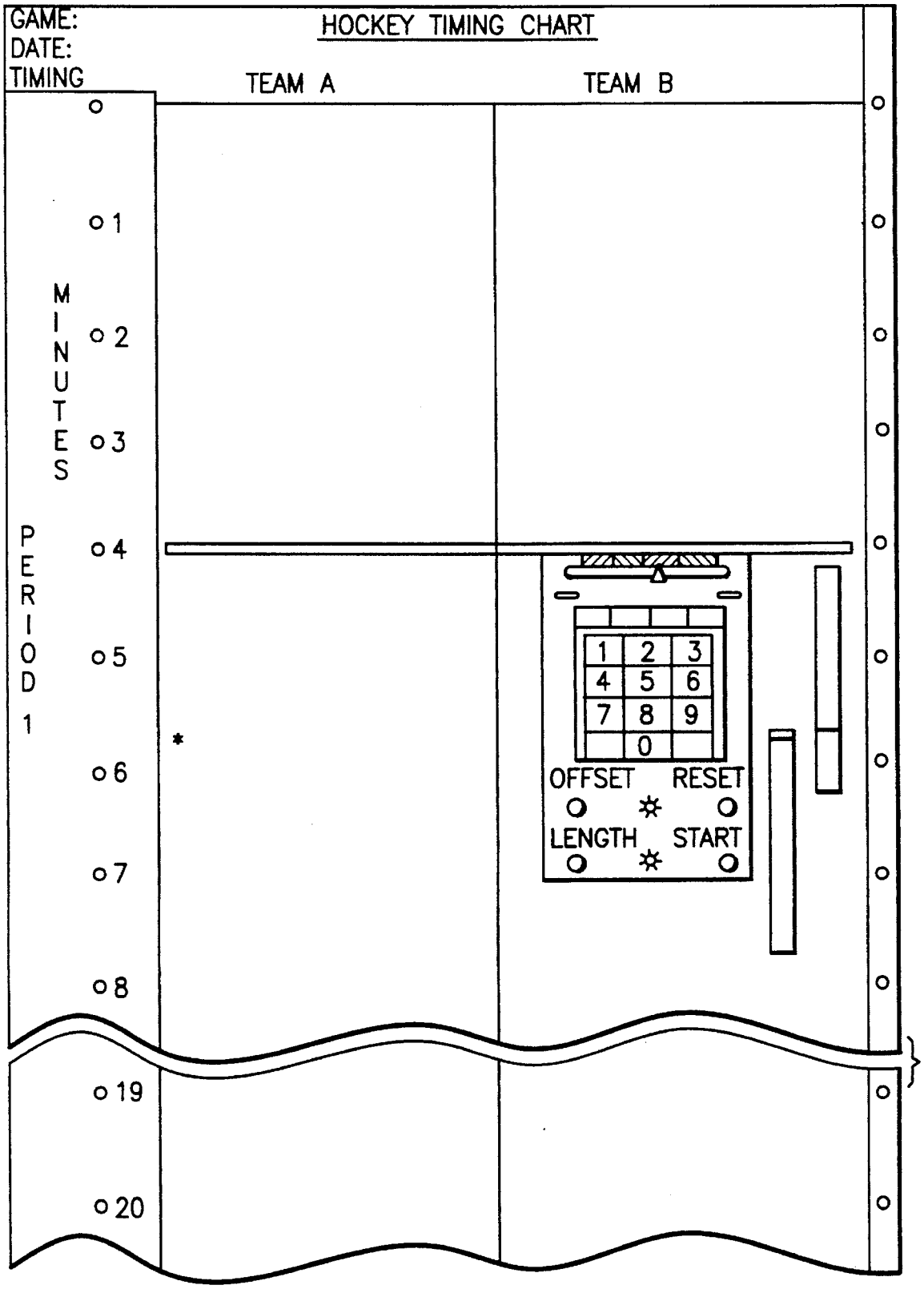

FIG. 17 shows how the results of a particular game are used.

PROCEDURE FOR PLOTTING GOALS

A. The mounting and alignment frame 34 is placed onto the timing chart 20 with reference marks at 3 minutes. The first travel frame 35, holding the second travel frame 36 is moved horizontally to the desired position. The OFFSET button is depressed, "19" is entered, and then the START button is depressed. A pen is used to make an appropriate mark through either of the pen slots 46.

B. Thereafter the mounting and alignment frame is placed at 4 minutes. The first travel frame 35, holding the second travel frame 36 is emplaced and moved horizontally.

The OFFSET key is depressed, "25" is entered, and then the START key is depressed, and the timing chart 20 is marked, pushing a pen through one of the slots 46.

C. Then the mounting and alignment frame is placed at 7 minutes. The first travel frame 35, holding the second travel frame 36 is emplaced and moved horizontally. The OFFSET key is depressed, "7" is entered, and the START key is depressed, and the timing chart 20 is marked, pushing a pen through the other slot 46.

PROCEDURE FOR PLOTTING PENALTIES

Points D & E. The mounting and alignment frame 34 is placed at 2 minutes. The first travel frame 35, holding the second travel frame 36 is emplaced and moved horizontally. The OFFSET key is depressed, "16" is entered; then the START key is depressed; then the LENGTH key is depressed, "120" entered, and now the START key is again depressed.

Points F & G. The mounting and alignment frame 34 is placed at 3 minutes. The first travel frame 35, holding the second travel frame 36 is emplaced and moved horizontally. The OFFSET key is depressed, "7" is entered, then the START key is depressed; then the LENGTH key is depressed, "300" is entered, and now the START key is again depressed.

Points H and I. The same above-noted procedure is used, with, with the OFFSET key at "56", and the LENGTH key at "120".

After the entire game has been entered, hockey rules for infringements are looked for; the rules are discussed in more detail in the section of the rules governing ice hockey in the appendix of this application. Changes may have to be made in the starting and ending times of some penalties. If a penalty is cut short, this can be shown by crossing out the tail end with a pen, using the digital planimeter 86, or the motorized first and second travel frame units 35 and 36 to assist in locating the appropriate points. To change the starting point of a penalty, the old tape is pulled off, and the new penalty is replotted at the correct starting point, as in the above-outlined procedures.

EXAMPLES OF SCORING USING APPARATUS OF INVENTION

Power play for team "A" is penalty efficiency for Team "B". The tape dispenser includes tapes of respective multiple covers. With regards to "Legend" each noted situation is displayed as follows:

Example A:

Line #6: Team "A" is awarded a 2-minute power play at the 4:10 mark of the first period. Team "B" is charged 2-minutes of penalty time.

1) Place Alignment and Attachment bar to the 4-minute mark.

2) Place tape dispenser on alignment bar.

3) Adjust dispenser horizontally to Team "B" side.

4) With tape dispenser at starting point frame, (4-minute mark) hit offset button; key in on number pad "10" seconds; hit start.

5) Use digital tape dispenser to cut a blue tape strip from the 4:10 mark on timing chart for penalty time for Team "B". Hit lengths; enter "120" seconds on number pad for the two minutes of potential power play time; hit start. Cut tape. The one man penalty time tape for Team "B" is now on timing chart. Before Team "A" can score a goal, they are assessed a penalty of their own at 4:29. The following procedure would apply.

Example B:

Line #6: Team "A" is charged with a 2-minute penalty at the 4:29 mark of the first period.

6) Place Alignment and Attachment bar to the 4-minute mark on Team "A" side.

7) Place tape dispenser on alignment bar.

8) Adjust dispenser horizontally to Team "A" side.

9) With tape dispenser at starting point frame, hit offset button; key in on number pad "29" seconds; hit start.

10) Use digital tape dispenser to cut a blue tape strip from the 4:29 mark on the timing chart for penalty time for Team "A". Hit length, enter "120" seconds on number pad; hit start. Cut tape.

The one man penalty time tape for Team "A" is now on the timing chart.

11) Using pen tip, run horizontal line through Team "B" penalty tape strip at beginning of penalty tape strip for Team "A" (4:29). Using pen tip, run a horizontal line through Team "A" penalty tape strip at ending of Team "B" penalty (6:10).

Had this sequence been the only power play time in the entire game, the scoring would be as follows:

1) To account for Team "A" power play time using the planimeter, hit reset button; place planimeter at beginning of first penalty of game, (4:10) Team "B". Move planimeter down blue penalty tape strip "unit time" ridges track to pen line. Read planimeter. LCD now displays accrued one man seconds/time and composite power play seconds time for Team "A"0 for entire game which would be 19-seconds.

2) To account for Team "B" power play time using the planimeter, hit reset button; place planimeter at pen line on Team "A tape strip (6:10). Move planimeter down blue penalty tape strip "unit time" ridges to end of tape (6:29). LCD now displays accrued one man seconds/time and composite power play seconds/time for Team "B"0 for entire game which would be 19-seconds.

The events of this game would affect equations D,E,I,J, K,L and M for both teams power play. The events would effect equation P,Q,U,V,W,X and Y for both teams penalty efficiency.

Example C: 1 & 2

Line #10: Team "A" is awarded a two minute power play at the 4:10 mark of the first period. Team "B" is charged two minutes of penalty time.

1) Place Alignment and Attachment bar to the 4-minute mark.

2) Place tape dispenser on alignment bar.

3) Adjust dispenser horizontally to Team "B" side.

4) With tape dispenser at starting point frame, (4-minute mark) hit offset button; key in on number pad "10" seconds, hit start.

5) Use digital tape dispenser to cut a blue tape strip from the 4:10 mark on timing chart for penalty time for Team "B". Hit length; enter "120" seconds on number pad for the two minutes of potential power play time; hit start. Cut tape. The penalty time tape for Team "B" is now on timing chart. Team "A", having failed to score, is then awarded an additional two-minute power play at the 5:40 mark, or 30 seconds before the first two-minute power play would expire.

6) Place Alignment and Attachment bar to the 5-minute mark.

7) Place tape dispenser on alignment bar.

8) Adjust dispenser horizontally to Team "B" side.

9) With tape dispenser at starting point frame, (5-minute mark) hit offset button; key in on number pad "40" seconds; hit start.

10) Use digital tape dispenser to cut a black tape strip from the 5:40 mark on timing chart for two player penalty time for Team "B". Hit length; enter "30 seconds on number pad or remaining first penalty time; hit start. Cut tape. The two player penalty time tape for Team "B" is now on timing chart.

11) Using pen tip, run horizontal line through Team "B" first penalty strip equal to beginning of second penalty (5:40).

12) When the two player advantage for Team "B" expires (6:10), place Alignment and Attachment bar at 6:00, then repeat step 2 through 5 using blue tape to complete remaining one player time of second penalty (6:10 to 7:40).

Had this sequence been the only power play time in the entire game, and no goals were scored, the scoring would be as follows:

1) To account for Team "A" power play time using the planimeter for one man time on blue tape only; hit reset button; place planimeter at beginning of first penalty of game, (4:10) Team "B". Move planimeter down blue penalty tape strip "unit time" ridges track to pen line (5:40). Lift planimeter off timing sheet. Place planimeter at beginning of second blue penalty tape strip (6:10). Move planimeter down "unit time" ridges track to end of second blue penalty tape. Read planimeter. LCD now displays accrued one player seconds/time for Team "A". To account for Team "A" power play time using the planimeter for two man time on black tape only, hit reset button; place planimeter at beginning of second penalty of game, (5:40) Team "B". Move planimeter down black penalty tape strip "unit time" ridges track to where black tape ends. Remove planimeter off timing sheet. Read planimeter. LCD now displays accrued two man seconds/time for Team "A".

Had this sequence been the only power play time in the entire game, and no goals were scored, the scoring would be as follows:

2) Team "B" would have no power play time in this game. The events of this game would affect equations D,E,G,H,I, J,K L and M for Team "A" power play. The events would effect equation P,Q,S,T,U,V,X and Y for Team "B" penalty efficiency.

Example D:

Line #4: Team "A" scores a power play goal in 25-seconds. Team "A" is awarded a two minute power play at the 4:10 mark of the first period. Team "B" is charged 2-minutes of penalty time. Team "A" scores a power play goal at 4:35 of the first period or 25-seconds into the 2-minute penalty assessed to Team "B" at 4:10. Team "B" penalty time ends at 4:35, when Team "A" scored power play goal.

1) Place Alignment and Attachment bar to the 4-minute mark.

2) Place tape dispenser on alignment bar.

3) Adjust dispenser horizontally to Team "B" side.

4) With tape dispenser at starting point frame, (4-minute mark) hit offset button; key in on number pad "10" seconds; hit start.

5) Use digital tape dispenser to cut a blue tape strip from the 4:10 mark on timing chart for penalty time for Team "B". Hit length; enter "120" seconds on number pad for the two minutes of potential power play time; hit start. Cut tape. The one player penalty time tape for Team "B" is now on in the timing chart.

1) Place Alignment and Attachment bar on timing chart with reference marks at the 4-minute mark.

2) Place tape dispenser unit within starting point frame on Alignment and Attachment bar.

3) Move dispenser horizontally to Team "B" side.

4) Hit offset button, then enter "10" seconds and hit start.

5) Use pen tip within pen slot in tape dispenser to make appropriate mark (4:35).

Had this sequence been the only power play time in the entire game, and the only goal scored, the scoring would be as follows:

1) To account for Team "A" power play time using the planimeter for one player time on blue tape only, hit reset button; place planimeter at beginning of first penalty of game, (4:10) Team "B". Move planimeter down blue penalty tape strip "unit time" ridges track to pen line (4:35). Lift planimeter off timing sheet. Read planimeter. LCD now displays accrued one player seconds/time and composite one player seconds/time for Team "A" (25-seconds).

The events of this game would affect equations B,C,D, E,I,J,K L and M for Team "A" power play. The events would effect equations N,O,P,Q,U,V,W,X and Y for Team "B" penalty efficiency.

Example E:

Line #17: Team "A" is awarded a two minute power play at the 4:10 mark of the first period. Team "B" is charged two minutes of penalty time.

1) Place Alignment and Attachment bar to the 4-minute mark.

2) Place tape dispenser on alignment bar.

3) Adjust dispenser horizontally to Team "B" side.

4) With tape dispenser at starting point frame, (4-minute mark) hit offset button; key in on number pad "10" seconds; hit start.

5) Use digital tape dispenser to cut a blue tape strip from the 4:10 mark on timing chart for penalty time for Team "B". Hit length; enter "120" seconds on the number pad for the two minutes of potential power play time, hit start. Cut tape. The one player penalty time tape for Team "B" is now on the timing chart. Team "A" is then awarded an additional two-minute power play at the 5:40 mark, or 30-seconds before the first two-minute power play would expire.

6) Place Alignment and Attachment bar to the 5-minute mark.

7) Place tape dispenser on alignment bar.

8) Adjust dispenser horizontally to Team "B" side.

9) With tape dispenser at starting point frame. (5-minute mark) hit offset button; key in on number pad "40" seconds; hit start.

10) Use digital tape dispenser to cut a black tape strip from the 5:40 mark on timing chart for two player penalty time for Team "B". Hit length; enter "30" seconds on number pad or remaining first penalty time; hit start. Cut tape. The two man penalty time tape for Team "B" is now on the timing chart. Team "A" then scores a power play goal at 5:45 while on a two man advantage.

1) Place Alignment and Attachment bar on timing chart with reference marks at the 5-minute mark.

2) Place tape dispenser unit within starting point frame on Alignment and Attachment bar.

3) Move dispenser horizontally to Team "B" side.

4) Hit offset button, then enter "45" seconds and hit start.

11) Use pen tip within pen slot in tape dispenser to make appropriate mark (5:45).

12) Using pen tip, run horizontal line through Team "B" first penalty strip equal to beginning of second penalty (5:40).

13) The two man disadvantage for Team "B" expires at 5:45, or when Team "A" scored at 5:45. Place Alignment and Attachment bar at 5:00; then repeat step 2 through 5 using blue tape to complete remaining one man time with starting time at 5 minute mark and offset at 45-seconds (5:45 to 7:40). Team "A" then fails to score in the remaining 1:55 of penalty time assessed to Team "B" at 5:40.

Had this sequence been the only power play time in the entire game, and one goal was scored, the scoring would be as follows:

1) To account for Team "A" power play time using the planimeter for one player time on blue tape only, hit reset button; place planimeter at beginning of first penalty of game, (4:10) Team "B". Move planimeter down blue penalty tape strip "unit time" ridges track to pen line (5:40). Lift planimeter off timing sheet. Place planimeter at beginning of second blue penalty tape strip (5:45). Move planimeter down "unit time" ridges track to end of second blue penalty tape. Read planimeter. LCD now displays accrued one player seconds/time for Team "A" 3 minutes and 25 seconds. To account for Team "A" power play time using the planimeter for two player time on black tape only; hit reset button; place planimeter at beginning of second penalty of game, (5:40) Team "B". Move planimeter down black penalty tape strip "unit time" ridges track to where black tape ends (5:45). Remove planimeter off timing sheet. Read planimeter. LCD now displays accrued two player second/time for Team "A" five seconds.

The events of this game would affect equations B,D,E,F, G,H,I,J,K,L and M for Team "A" power play. The events would effect equations N,P,Q,R,S,T,U,V,W,X and Y for Team "B" penalty efficiency.

Thus, the present invention provides an apparatus and method for obtaining selected performance statistics, for example, of one or more teams engaged in competitive hockey scores, by extensive manipulation of time frame statistics, from a game box score, generally provided by newspapers. The present invention achieves this manipulation automatically in a novel advantageous manner.

Other modifications may be made to the present invention, in other related environments, without departing from the spirit and scope of the present invention, as noted in the appended claims.

APPENDIX I

Rules Governing The Game Of Ice Hockey

RINK/GOAL NETS

Ice hockey is played on an ice skating rink. A regulation rink is 200-feet long by 85-feet wide. The rink is surrounded by sideboards which reach as high as 8-feet, Fifteen feet from each end of the rink centered by the rink width are goalposts standing 4-feet high, 6-feet wide and 3-feet deep. The post and attached crossbars are draped with nylon mesh in such a manner as to assure the puck coming to rest on the inside of the net. The red line, two inches wide, between the goal posts on the ice extended completely across the rink, shall be known as the "Goal Line". A semi-circle outside the goalnet consisting of approximately 25-square feet extending from the left goalpost to the right goalpost shall be known as the goaltenders crease.[1]

[1]adopted in 1991

ON-ICE OFFICIALS

A hockey game is governed by three on-ice officials, a referee and two linesmen. The referees duty is to call player penalties, direct instructions to both team coaches and to have an uncontested influence on the game clock and penalty clock. The referee shall have general supervision of the game. The linesman duty is to stop play whenever there is an offsides play, an icing, or to call a bench minor penalty. The linesman shall drop the puck for every face-off except those that begin a period and those which follow a goal.

OFF-ICE OFFICIALS

Each rink shall provide two goal judges, who are seated behind each goal net to indicate when a goal is scored by illuminating a red light which is situated behind each goal net. Each rink shall provide a timekeeper and scorekeeper who operate the game clock/penalty clock and record each goal scored or penalty assessed respectively.

TIME OF MATCH

The time allowed for a game shall be three twenty-minute periods of actual play, with a rest intermission between each period. If the game remains tied at the conclusion of three periods, the results of the game for each team is recorded as a tie. A five-minute overtime period shall be played in the event that a game is tied after three 20-minute periods.[2]

[2]adopted in 1979

DIVISION OF ICE SURFACE

The ice surface is divided into three zones with blue lines at 70-feet from each end of the rink diagonally that shall be the "Attacking" and "Defending" zones and a red line at center ice which has 30-feet of playing surface at either side. This is the "Center Ice" zone. The surface is marked by face-off circles at dead center-ice, two in each defending/attacking zone at the left and right equally from the goal-mouth and two in each 30-foot zone separated by the red-line. All face-off spots (where the puck is dropped) are to be 20-feet from the sideboards that surround the rink.

There are a total of nine face-off spots.

PLAYERS/PENALTY BENCH

Each team shall have a separate players bench in which the reserve players await their turn to participate in the game. Each team is permitted 18 skaters and 2 goaltenders. The roster is submitted to an official scorer prior to the start of a game. Each rink must be provided with benches or seats to be known as the "Penalty Bench". Separate penalty benches must be provided for each team. The purpose of the penalty bench is for players guilty of committing a foul during the course of the game to be restricted to these benches until their penalty time has expired. The penalty benches shall be separated by the timekeepers/scorers bench.

TIMING DEVICES

Each rink must be provided with a siren or horn or other suitable sound device, for use by the timekeeper. The device is used to signal the end of each period and/or to signal when a goal is scored. A timing device is used to operate the game clock and penalty clocks. The game/penalty clocks run without interruption unless otherwise signaled by an on-ice official. The clocks resume running time upon any face-off that resumes play.

THE SKATERS

A starting line-up consists of one right-wing, one left-wing one center, two defensemen and one goaltender. Any skater may play any position except goaltender during any game.

CHANGE OF PLAYERS

A coach may change any combination of players except the goaltender "on the fly" (during play) or at any whistle. The home team coach will have the benefit of making the last player change if so desired. A team may change their goaltender during any play stoppage and may replace him with an additional skater at any time during the course of the game.

PLAYER EQUIPMENT

The mandatory player equipment is ice skates, gloves, shoulder pads, knee pads, elbow pads, helmets and a stick. The goaltender may use similar equipment, and additionally may use a catching glove and a blocker for his hands and enlarged goaltenders pads for his leg area covering the top knee area to around his skates at both sides, and not to exceed 10 inches in width. The goaltender may also wear equipment to shield the neck and upper torso area and may use a somewhat enlarged stick at the shaft to the blades tip.

PUCK

The puck is the object that the players will attempt to deposit in the opponents goal net. It is one inch thick and three inches in diameter. It shall weigh between five and a half ounces and six ounces. The home team shall provide the pucks for each game, which are kept frozen in ice near the timekeepers bench.

PENALTIES

Penalties shall be served in actual playing time and be divided into the following categories and time assessed:

A) Minor Penalty, 2-minutes

B) Bench Minor Penalty, 2-minutes

C) Double-Minor Penalty, 4-minutes

D) Major Penalty, 5-minutes

E) Misconduct Penalty, 10-minutes

F) Match Penalty, Remaining Game Time

G) Penalty Shot

A double major penalty may be assessed against a player that displays conduct that exceeds an intent to injure.[3]

[3]adopted in 1991

When a penalty is being served and team "A" has a manpower advantage, team "A" is on the "power play" and team "B" is "short-handed/penalty killing". Any player serving any penalty time, other than the goaltender, shall be ruled off the ice for the entire amount of playing time assessed, unless a power play goal is scored during a minor penalty that is not concurrent with an opponents penalty. During this time, no substitute shall be permitted for the penalized player. Under no circumstances will any team play with less than three skaters and one goaltender. A referee shall signal a stoppage in play when the offending teams touches the puck. When team "A" begins a minor power play at 4:45 and scores a power play goal ten seconds later, or at 4:55, then the penalized player for team "B" may leave the penalty bench at 4:55 and team "B" is no longer short-handed. Team "A" may use the entire 2-minutes of minor power play time if needed. If at the conclusion of the minor penalty a power play goal is not scored, the penalized player for team "B" may leave the penalty bench immediately upon the expiration of the 2-minutes (6:45).

During any 2-minute minor "power play", a player is permitted to leave the penalty bench immediately upon the scoring of a power play goal by their opponent.

When team "A" is on the power play and then incurs a penalty that is not coincidental with team "B", the power play for team "A" has expired.

During a 4-minute double minor power play, the penalized player shall serve two, 2-minute penalties in succession. Should team "A" score a power play goal 30-seconds into the first 2-minute penalty, the first 2-minute penalty shall be expired and the penalty clock will reset to 2-minutes of penalty time remaining in the double minor.

When team "B" incurs three minor penalties in succession, the third penalty (delayed penalty) shall not commence until either, a) team "A" scores a "power play goal", or b) the first penalty of the three called in succession has expired. The players may only re-enter the game upon stoppage of play. During any 5-minute major power play, the player must serve the entire 5-minutes regardless of how many power play goals are scored and may leave the penalty bench only after a play stoppage has occurred.

When team "A" and team "B" incur coincidental minor or major penalties, then neither team gains a manpower advantage and the penalty time is served in full by the players assessed the penalties.

A team is permitted to substitute for a player who is serving penalty time for a 10-minute misconduct. The player must however remain on the penalty bench until the penalty has expired. All penalties that overlap into the next period shall be served in their entirety.

A 2-minute penalty may be assessed for the following infractions:

1) Tripping-Use of the stick or body to trip an opponent.

2) Holding-Use of hands to impede the progress of opponent.

3) Hooking-Use of stick to impede the progress of opponent.

4) Interference-Impeding the progress of opponent not in lasting possession of the puck.

5) Cross-Checking-Use of stick in diagonal manner against opponents body with two hands.

6) Elbowing-Use of elbows against opponent.

7) Roughing-Body contact in an unsportsmanlike manner.

8) Instigator-Instigate fight with opponent.

9) Delay of game-Holding puck, shooting puck in stands.

10) Illegal equipment-gloves, broken sticks, illegal stick.

11) Unsportsmanlike Conduct-Verbal abuse of official.

12) Bench Minor-Abuse from bench, two many men on ice. A four-minute double minor penalty can be assessed for the following infraction should the referee rule the foul to be flagrant:

1) Boarding

2) Charging

3) High-Sticking

4) Roughing

5) Cross-Checking[4]

[4]adopted in 1991

A 2-minute minor penalty, or 5-minute major penalty may be assessed for the following infractions according to severity of penalty. Should it be determined that there was an intent to injure opponent, or if in fact a player has caused an opponent bodily injury (loss of blood) an automatic 5-minute major penalty and a game misconduct penalty are assessed against the offender. The player must leave the playing rink and his team must place a player in the penalty bench to serve the major power play time.

1) High-Sticking-Use of stick above shoulders to restrain or "check" opponent. Intent to injure opponent.

2) Slashing-Use of stick in a chopping fashion against opponent body or stick. Intent to injure.

3) Charging-Taking three or more strides then making bodily contact with an opponent. Intent to injure.

4) Boarding-Use of sideboards to check or restrain opponent. Intent to injure.

5) Kneeing-Use of knee to impede the progress of opponent.

6) Butt-Ending-Use of stick butt-end against opponent.

7) Spearing-Use of stick blade to impede opponent.

8) Fighting-Dropping of gloves and engaging in fisticuffs.

9) Cross-Checking-Use of stick in a diagonal manner against opponents body with two hands.

A 10-minute misconduct penalty, a game misconduct penalty, a gross misconduct penalty or a double gross misconduct penalty may be assessed for the following infractions.

1) The 3rd fighting major penalty assessed against a player in a game.

2) A player refusing to report directly to the penalty bench when assessed any penalty.

3) Spitting, kicking, biting, or otherwise behaving in an unsportsmanlike manner.

4) Leaving the player bench, penalty bench or a goaltender leaving the goalcrease to join an altercation.

5) Flagrant abuse of any on-ice or off-ice official.

6) Any player that may intervene in an altercation in progress.

An infraction of the rules which calls for a "Penalty Shot" shall be taken as follows:

1) A defending player other than the goaltender, covers the puck in the goalcrease in such a manner as to cause a stoppage of play.

2) A skater, on a clear breakaway towards the opponents goalnet, is fouled from behind by an opponent in such a manner that effects the skaters ability to shoot uncontested an opponents goalnet.

3) Any player that removes the goalpost from its moorings with less than 2-minutes remaining in the third period or an overtime period.

When a "Penalty Shot" is signaled by the referee, play is stopped and the awarded team is permitted to designate any of the players who were on the ice when the infraction was called, to take the "Penalty Shot". The skater shall gain possession of the puck at the "Center-Ice" face-off spot and proceed unmolested at opponents goalnet skating in a forward motion at all times. The skater is permitted one shot only. The skater must shoot the puck before passing the goalmouth, otherwise the "Penalty Shot" is forfeited.

The goaltender must remain in the goalcrease until the. skater has crossed the "Attacking Zone" blue-line, at which time he may leave the goalcrease and approach the skater.

The goaltender may not throw or remove equipment or otherwise interrupt the progress of the skater until the shot has been taken.

Any interference with the skater during a "Penalty Shot" is recorded as an automatic goal for the attacking team.

GOALTENDERS PENALTIES

The goaltender may remain in the goalcrease when he incurs any series of minor penalties, major penalties or a misconduct penalty during play. However, the penalty time must be served by a player who was on the ice when the infraction occurred.

Should a goaltender incur a major penalty/intent to injure, the referee shall order the goaltender removed from the game. Should a goaltender leave the goalcrease during play to enter an altercation, he will incur a minor penalty and may incur a game-misconduct penalty. The referee may order the goaltender removed from the game.

Should a goaltender participate in any play beyond the "Center-Ice" red-line, a minor penalty shall be assessed against him.

FACE-OFFS

The puck shall be faced-off by the referee or the linesman dropping the puck on the ice between the sticks of the players facing-off. Players facing-off will stand squarely facing their opponents' end of the rink, one stick length apart, with the blade of their stick on the ice.

No other player shall encroach the face-off circle or come within fifteen-feet of the players facing-off.

Any player not facing-off, shall line-up as to not encroach an imaginary off-sides line, that shall run parallel with the blue-line/red-line of any zone.

No face-off shall be made within fifteen feet of the goalnet or sideboards.

When a penalty is incurred, the ensuing face-off shall be in the offending teams defensive zone, unless otherwise over-ruled by an icing-the-puck by the attacking team, in which case the ensuing face-off shall be made in the attacking teams defensive zone.

A face-off shall follow the events hereby described:

1) Scoring of a goal

2) Following a penalty

3) To begin a period

4) Following any play stoppage that does not coincide with the completion of a period/game.

GOALS AND ASSISTS

When a goal is scored, the referee shall whistle a play stoppage and identify the goal scorer to the game scorer. The ensuing face-off shall take place at center-ice.

A goal shall be awarded when the entire puck has crossed the entire goal-line that extends between the two goal post.

A goal shall be awarded when the puck strikes a defending player and lodges into the net.

A goal shall be awarded when the puck strikes an attacking player and lodges into the net.

Assists shall be credited to the last two players of the attacking team who touched the puck before the goal was scored.

In the event that a goal was inadvertently scored by a defending player into his own net, the nearest attacking player to the defending player will be credited with the goal. A goal is disallowed when the following situation occurs:

1) The team scoring the goal is offsides.

2) The team scoring the goal has too many men on the ice.

3) The team scoring the goal was in a delayed penalty status.

4) The team scoring the goal kicked the puck into the net.

5) The team scoring the goal directs the puck into the net with his hand.

6) The period ends before the puck crossed the goal-line.

7) The referee has stopped play before the puck crossed the goal-line.

ICING

The center line divides the ice surface in halves. Should any player of a team equal or superior in numerical strength to the opposing team, shoot or bat the puck from his own half of the ice, beyond the goal line of the opposing team, play shall be stopped and the puck faced-off at the end face-off spot of the offending team, when the defending team touches the puck before the offending team, unless on the play the puck has entered the net of the opposing team, in which case a goal shall be awarded. If a linesman has erred in calling an "icing", the puck shall be faced-off at the center-ice face-off spot. Play shall be stopped and the puck faced-off at the end face-off spot of the offending team when the puck crosses the goal line outside of the net. The defending team is no longer required to touch the puck before the offending team.[5]

[5]adopted in 1993

OFFSIDES

A player must precede the puck into the attacking zone. A player may pass, carry, or shoot the puck into the attacking zone as long as the puck enters the attacking zone before either of his feet. When a player enters the attacking zone before the puck, the linesman shall whistle a stoppage of play and a face-off will take place in the attacking teams neutral zone. The side of the ice in which the infraction was called will determine the left or right-side face-off spot. If a linesman has erred in calling an off-side, the puck shall be faced-off at center-ice. The linesman may not stop play when a player is offsides and proceeds back into the neutral zone without the intention of making a play on the puck.[6]

[6]adopted in 1990

PASSES

The puck may be passed by any player to a player on the same team within any one of the three zones into which the ice is divided, but may not be passed forward from a player in one zone to a player of the same team in another zone, except by a player on a defending team, who may make and take forward passes from their own defending zone to the center-line without incurring an off-side.

If an attacking player passes the puck backward toward his own goal from the attacking zone, an opponent may play the puck anywhere regardless of whether he (the opponent) was in the same zone at the same time the puck was passed or not. The goaltender may pass the puck to any teammate in which the pass is completed in his own half of the ice. The goaltender may catch the puck with his glove but may not toss or throw the puck forward at any time.

PUCK KEPT IN MOTION

The puck must at all times be kept in motion. Except to carry the puck behind its goalnet once, the team in possession of the puck in its own defensive area shall always advance the puck toward the opponents goal, except if they should be prevented from so doing by players of the opposing team.

START OF GAME

The game shall be commenced at the time scheduled by a "face-off" at the center-ice spot.

The home team has the choice of what goalnet to defend. The teams will alternate goalnets to defend when the next period begins.

Each team shall have fifteen-minutes of warm-up time to use the ice and prepare for each contest. The ice shall be vacated twenty minutes before the game begins by both teams, in order to allow the ice surface to be reconditioned.

OBJECTIVE

The object of the game is to score as many goals as possible against the opponent and to outscore the opponent within the guidelines of the time allocated.

When a team scores a goal, they are credited with one goal for the game. A team may only score one goal per play. The team with the most goals at the conclusion of play wins the game and gets credit for two-points in the standings. A team that loses the game gets zero points in the standings.

When the final result of a game is a tie, both teams receive one point in the standings.

APPENDIX II

Illustration #AP box score from newspaper

EDMONTON .....0 3 1—4
WINNIPEG .....2 0 0—2

EDM: A wn
Graves (4/+1), Gregg (1/-1), Huddy [illegible] +1), Kurri (1/0), Lamb (1/0), Lowe (1/+1), [illegible] (0/0), Muni (1/+1), Murphy (1/0), Ranford, Hedrick (dnp), Ruotsalainen (5/0), Simpson (2/-1), G. Smith (3/-1), S. Smith (1/+1), Tikkanen (4/0). [illegible]
WPG: Ashton (1/-1), Beauregard, Cronin (1/0), Donnelly (1/0), Ellett (3/-1), Elynuik (2/-2), Essensa (dnp), Evans (0/-1), Fenton (4/0), Filchet (0/0), Hawerchuk (1/0), Kumpel (0/0), MacDermid (1/+1), Marchment (0/0), McLlwain (2/0), Numminen (1/-2), Paslawski (2/-1), Small Sykes (0/0), Tagliametti (2/+1).

First Period

1. Wp hton 22 (Ellett, Fenton), 10:24
2. Wp nuik 32 (Numminen, Hawerchuk), (pp) 19:27
Pen— anetti, Wpg (hooking), 2:16, Murphy, Edm (elbov 5:05, Klima, Edm (roughing), Tagliametti, Wpg (interf e), 10:45, Simpson, Edm, Beauregard, Wpg (rougl 11:11, Simpson, Edm (roughing), Ellett, Wpg (interf e, roughing), 13:54, Murphy, Edm (slashing), Denn N wn, Edm (cross check lin (major), Cronin, Wpg (fighting (major), misco t (10 min)), 17:33, S. Smith, Edm (cross check :48.

Second Period

3. Ed rri 33 (Ranford), (sh) 12:28
4. Edm, Simpson 29 (Kurri, Ruotsalainen), (pp) 18:14
5. Edm, Anderson 34 (G. Smith, Ruotsalainen), (pp) 18:52
Pen—MacDermid, Wpg (roughing), 0:56, G. Smith, Edm (slashing), 2:08, Elynuik, Wpg (tripping), 4:22, Brown, Edm (elbowing, high stick), 8:50, Hawerchuk, Wpg (game misconduct), Marchment, Wpg (high stick (major), game misconduct), 14:55, Tagliametti, Wpg (hooking, misconduct (10 min)), 17:06.

Third Period

6. Edm, Klima 30 (Anderson, Gravely), (sh) 19:23
Pen—S. Sr Lamb, Edm (hooking) 1:19, Wpg bench (too many men/ice), 2:38, Ruotsalainen, Edm, (holding), 9:38, Simpson, Edm (misconduct (10 min)), 14:17, Huddy, Edm (holding), 15:02, Gregg, Edm (slashing), 16:33, Huddy, Edm (tripping) 19:44.

| Shots On Goal: | 1 | 2 | 3 | O | T |
|---|---|---|---|---|---|
| Edm | 15 | 10 | 7 | — | 32 |
| Wpg | 10 | 4 | 9 | — | 23 |

| Goaltenders: | Time | SA | GA | ENG | DEC. |
|---|---|---|---|---|---|
| Edm, Ranford (24-16-9) | 60:00 | 23 | 2 | 0 | W |
| Wpg, Beauregard (7-8-3) | 59:09 | 32 | 3 | 1 | L |

PP Conversions: Edm: 2/6, Wpg: 1/10. Referee: Rob Shick. Linesmen: Swede Knox, Brad Lazarowich.

APPENDIX III

Mathamatical Formulation for the purpose of using the TIME-FRAME method in determining the ranking of The National Hockey Leagues' 21 teams' Special Teams' Efficiency.

| | | |
|---|---|---|
| Sample Game: | NHL game # 839 Edmonton Oilers vs. Winnipeg Jets<br>4/01/90<br>Starting goaltenders: Edm. B. Ranford; Wpg. S. Beauregard | |
| | 1st Period: | |
| | WPG Penalty: P. Taglianetti-Minor | Starts at 2:16 |
| | EDM man advantage | Starts at 2:16 |
| | Result: EDM does not score. | Ends at 4:16 |
| PP# 1 | EDM accrued time | 0 for 2:00 Composite time |
| | EDM Penalty: J. Murphy-Minor | Starts at 6:05 |
| | WPG man advantage | Starts at 6:05 |
| | Result: WPG does not score. | Ends at 8:05 |
| PP# 1 | WPG accrued time | 0 for 2:00 Composite time |
| | EDM Penalty: P. Klima-Minor | Starts at 10:45 Offset |
| | WPG Penalty: P. Taglianetti-Minor | Starts at 10:45 Offset |
| | Result: Offsetting Penalties | No accrued Power Play time |
| | EDM Penalty: C. Simpson-Minor | Starts at 11:11 Offset |
| | WPG Penalty: S. Beauregard-Minor | Starts at 11:11 Offset |
| | Result: Offsetting Penalties | No accrued Power Play time |
| | EDM Penalty: C. Simpson-Minor | Starts at 13:54 Offset |
| | WPG Penalty: D. Ellet-Double-Minor | Starts at 13:54 |
| | EDM man advantage | Starts at 13:54 |
| | Result: EDM does not score | |
| PP# 2 | EDM accrued time | 0 for 2:00 Composite time |
| | EDM Penalty: J. Murphy-Minor | Starts at 16:31 |
| | WPG Penalty: G. Donnelly-Minor | Starts at 16:31 |
| | Result: Offsetting Penalties | No accrued Power Play time |
| | EDM Penalty: D. Brown-Minor,Major | Starts at 17:33 |
| | WPG Penalty: S. Cronin-Major,Misconduct | Starts at 17:33 Offset |
| | WPG man advantage | Starts at 17:33 |
| | Result: EDM Penalty; S. Smith-Minor | Starts at 18:48 |
| PP# 2 | WPG accrued time | 0 for 1:15 Composite time |
| | WPG Two-man advantage | Starts at 18:48 |
| | Result: WPG scores at 19:27 | |
| PP# 3 | WPG accrued time | 1 for 0:39 Two-Man time |
| | WPG man advantage | Starts at 19:28 |
| | Result: WPG does not score. | Ends at 0:48 2nd period |
| | WPB accrued time | 0 for 1:21 Composite time |
| | 2nd Period: | |
| | WPG Penalty: P. MacDermid-Minor | Starts at 0:56 |
| | EDM man advantage | Starts at 0:56 |
| | EDM Penalty: S. Smith-Minor | Starts at 2:08 |
| | Result: EDM does not score | |
| PP# 3 | EDM accrued time | 0 for 1:12 Composite time |
| | WPG man advantage | Starts at 2:56 |
| | Result: WPG does not score | |
| PP# 4 | WPG accrued time | 0 for 1:12 Composite time |
| | WPG Penalty: P. Elynuik-Minor | Starts at 4:32 |
| | EDM man advantage | Starts at 4:32 |
| | Result: EDM does not score | |
| PP# 4 | EDM accrued time | 0 for 2:00 Composite time |
| | EDM Penalty: D. Brown-Double-Minor | Starts at 8:56 |
| | WPG man advantage | Starts at 8:56 |
| | Result: WPG does not score | Ends at 12:56 |
| PP# 5&6 | WPG accrued time | 0 for 4:00 |
| | WPG Penalty: B. Marchment-Major,Game Misc | Starts at 14:55 |
| | WPG Penalty: D. Hawerchuk-Game Misconduct | |
| | EDM Major time advantage | Starts at 14:55 |
| | WPG Penalty: P. Taglianetti-Minor,Misc | Starts at 17:06 |
| PP# 5 | EDM accrued time | 0 for 2:11 Major,Composite |
| | EDM Two-Man advantage | Starts at 17:06 |
| | Result: EDM scores at 18:14 | |
| PP# 6 | EDM accrued time | 1 for 1:08 Two-man time |
| | EDM Major time advantage | Starts at 18:15 |
| | Result: EDM scores at 18:52 | |
| | EDM accrued time | 1 for 0:37 Major,Composite |
| | EDM Major time advantage | Starts at 18:53 |
| | Results: EDM does not score | Ends at 19:55 |
| PP# 7 | EDM accrued time | 0 for 1:02 Major,Composite |
| | 3rd Period: | |

-continued

| | | |
|---|---|---|
| | EDM Penalty: S. Smith-Minor | Starts at 0:52 |
| | WPG man advantage | Starts at 0:52 |
| | EDM Penalty: M. Lamb-Minor | Starts at 1:19 |
| PP# 7 | WPG accrued time | 0 for 0:27 Composite time |
| | WPG Two-man advantage | Starts at 1:19 |
| | WPG Penalty: Bench-Minor | Starts at 2:38 |
| PP# 8 | WPG accrued time | 0 for 1:19 Two-Man time |
| | WPG man advantage | Starts at 2:38 |
| | Result: WPG does not score | End at 2:52 |
| | WPG accrued time | 0 for 0:14 Composite time |
| | EDM man advantage | Starts at 3:19 |
| | Result: EDM does not score | Ends at 4:38 |
| PP# 8 | EDM accrued time | 0 for 1:19 Composite time |
| | EDM Penalty: R. Ruotsalainen-Minor | Starts at 9:38 |
| | WPG man advantage | Starts at 9:38 |
| | Result: WPG does not score | Ends at 11:38 |
| PP# 9 | WPG accrued time | 0 for 2:00 Composite |
| | EDM Penalty: C. Simpson-Misc | Starts at 14:17 |
| | Result: No WPG advantage | |
| | EDM Penalty: C. Huddy-Minor | Starts at 15:02 |
| | WPG man advantage | Starts at 15:02 |
| | EDM Penalty: R. Gregg-Minor | Starts at 16:33 |
| PP# 10 | WPG accrued time | 0 for 1:31 Composite time |
| | WPG Two-man advantage | Starts at 16:33 |
| | Result: Wpg does not score | Ends at 17:02 |
| PP# 11 | WPG accrued time | 0 for 0:29 Two-man time |
| | WPG man advantage | Starts at 17:03 |
| | Result: WPG does not score | Ends at 18:33 |
| | WPG accrued time | 0 for 1:30 Composite |
| | EDM Penalty: C. Huddy-Minor | Starts at 19:44 |
| | WPG man advantage | Starts at 19:44 |
| | Result: WPG does not score | Ends at 20:00 |
| PP# 12 | WPG accrued time | 0 for 0:16 |

Breakdown of accrued time

| Winnipeg Jets | | Edmonton Oilers | |
|---|---|---|---|
| PP# 1 | 0–2:00 one-man time | PP# 1 | 0–2:00 one man time |
| PP# 2 | 0–1:15 one-man time | PP# 2 | 0–2:00 one man time |
| PP# 3 | 1–0:39 one-man time | PP# 3 | 0–1:12 one man time |
| PP# 3 | 0–1:21 one-man time | PP# 4 | 0–2:00 one man time |
| PP# 4 | 0–1:12 one-man time | PP# 5 | 0–2:11 one man time |
| PP# 5 | 0–2:00 one-man time | PP# 6 | 1–1:08 one man time |
| PP# 6 | 0–2:00 one-man time | PP# 6 | 1–0:38 one man time |
| PP# 7 | 0–0:27 one-man time | PP# 7 | 0–1:03 one man time |
| PP# 8 | 0–1:19 one-man time | PP# 8 | 0–1:19 one man time |
| PP# 8 | 0–0:14 one-man time | | |
| PP# 9 | 0–2:00 one-man time | | |
| PP# 10 | 0–1:31 one-man time | | |
| PP# 11 | 0–0:29 one-man time | | |
| PP# 11 | 0–1:30 one-man time | | |
| PP# 12 | 0–0:16 one-man time | | |
| Totals | 0–15:46 One-man time | Totals | 0–8:31 One-man time |
| | 1–2:27 Two-man time | | 1–1:08 Two-man time |
| | 0–0:00 Major-time | | 2–3:52 Major-time |
| | 1–20:40 Composite time | | 2–14:33 Composite time |

We claim:

1. In a converting device for converting a box score in hockey game eventually to final statistics relating to composite power play, composite penalty efficiency, two-player power-play, two-player penalty efficiency, major power play, major penalty efficiency, composite hot seat, hot seat two-player disadvantage, hot seat major disadvantage, and earned goal average, and wherein said final statistics are, in turn, obtainable from intermediate statistical data, the improvement, wherein said intermediate statistical data are identifiable by a combination of respective letters and/or numbers, and are feedable into a standard calculator or computer so as to obtain said final statistics therefrom, comprising in combination a longitudinal carriage adapted to have a timing chart affixed thereto, converting means for obtaining said intermediate statistical data from said box score, said converting device including said timing chart being disposed in parallel with a first axis, calibrated at predetermined major intervals, and denotable along a second axis perpendicular to said first axis with a first team, followed sequentially by a second team normally opposing said first team, tape holding means defining a center axis, said center axis being positionable in parallel with said second axis, said tape holding means being adaptable for carrying a plurality of at least three tape reels with respective differently identifiable tapes, tape unrolling means for unrolling at least one of said tapes from said tape holding means, tape dispensing means for dispensing said at least one of said tapes, tape dispensing control means for controlling said tape dispensing means, mobile length measuring means operably movable in a forward direction within 180 degrees along generally arbitrary moving directions from a starting position to an end position, for measuring a predetermined length of at least said one of said tapes, so as to substantially be independent of said movement-direction, and thus become substantially movement-direction independent, provided that a path taken by said mobile length measuring means between said positions does not have a component in any direction opposite to the forward direction, conversion means for changing said mobile length measuring means to stationary length measuring means with respect to said carriage, marking means on said tape dispensing means for marking chosen or other parameters on said timing chart, tape selection means spaced apart from, opposite to, and cooperating with said tape holding means for selecting one of said tapes, tape restraining means for restraining said one of said tapes to follow a predetermined path, cutting means for cutting off said predetermined length of said one of said tapes from said tape dispensing means, adhesive means for laying down and adhering said predetermined length of said one of said tapes onto, and to said timing chart, respectively, so as to extend in parallel with said first axis, engagement means between said timing chart, and said tape unrolling means, and translatory moving means for automatically moving said carriage in a direction parallel to said first axis and relative to said timing chart along a translation direction between an initial placement denoting zero tape travel, and a second position away from said initial position, denoting distance traveled from said initial position, at least said tape dispensing means, said tape-dispensing control means, said stationary length measuring means, said marking means, said tape selection means, said tape unrolling means, said tape restraining means, and said cutting means being contained in said carriage, and wherein said carriage is manually movable in a direction parallel to said second axis, so as to obtain a selected position of said carriage with respect to said timing chart.

2. The converting device according to claim 1, wherein said converting means comprise a plurality of differently marked tapes with different respective colors.

3. The converting device according to claim 1, wherein said tape unrolling means comprise an electric motor rotatably attached to said carriage, and defining at least one motor axis substantially parallel with said second axis, at least one of said tape reels being couplable to said motor, and tape guiding means to guide said one of said plurality of tapes along a predetermined path within said carriage.

4. The converting device according to claim 3, wherein said one side of said carriage of said converting device comprises a floor, and wherein said tape restraining means comprises an elastomeric pressure pad generally juxtaposed with a portion of said floor, and part of said exit gap, said one of said tapes being passable through said exit slot.

5. The converting device according to claim 3, wherein said adhesive means include two sets of ridges spaced apart from one another on each side of said one of said tapes, respectively, so as to be equivalent to respective seconds in time, said timing chart including a front surface thereof spaced from one another, and cooperating with corresponding ridges on said one of said tapes, so that the cooperating ridges operatively mate with one another.

6. The converting device according to claim 3, wherein said cutting means comprises a blade guide means secured to said carriage, a blade thereof normally passing through said blade guiding means, and wherein a wedge is formed in one longitudinal side of said carriage, and an exit slot is defined between said wedge and a remaining part of said one longitudinal side, said blade guiding means being located above said exit slot, said at least one of said tapes being passable over said exit slot on being unrolled, whereby said predetermined length is cut off from said one of said tapes upon said blade passing over said exit slot when actuated by said length measuring means.

7. The converting device according to claim 6, wherein said length measuring means is initially mobile, and said length measuring means has a generally longitudinal shape and comprises a counter having forward-or backward-switchable modes, and being provided with a first input for accepting a signal, a second input thereof being connected to a groundable reset switch for resetting said counter to zero, a binary-to-digital converter accepting on an input thereof the output of said counter, and displaying the latter-named output, and means for actuating said cutting means upon said counter, operating in the backward mode, having proceeded from the displayed output to a count of zero.

8. The converting device according to claim 7, wherein the longitudinal shape of said length measuring means of said converting device is provided with a least two guide-posts on an input end thereof, and wherein said one side of said carriage formed with said exit slot includes a fixed-location first transducer, and a stylus connected with one end thereof to said fixed location transducer, and being with the other end thereof in operative contact with said ridges of said timing chart, said fixed location transducer being additionally formed on an output end thereof with two recesses mating with respective of the latter-named guide-posts for being snapped thereinto, and wherein said length measuring device is formed with an input for accepting an output of said fixed-location transducer, whereby, upon the output of said fixed location transducer being connected to said first and signal accepting input of said length-measuring means, and upon said guide-posts being snapped into respective of said recesses, said longitudinal shape becomes connected to, and rigid with said carriage of said converting device, so that said initially mobile length measuring means becomes a fixed location length measurement means with respect to said carriage.

9. The converting device according to claim 7, serving as input means to said length measuring means, said input means comprising, in combination, a stylus having an output, a piezo-electric or magnetic transducer having an output, and an input for accepting the output of said stylus, a pulse shaper having an input for accepting the output of said transducer, and an output operatively providing a plurality of pulses.

10. The converting device according to claim 1, wherein said converting means further comprise a mounting and alignment frame alignable with said timing chart in a plurality of discrete steps, each of said steps corresponding to an interval of one minute, and including a rail parallel to said second axis, wherein said second axis is substantially horizontal, and a first travel frame arranged in said mounting and alignment frame, and having a longitudinal base provided with a bore, said rail being passable therethrough, so that said first travel frame is slidable along said rail in a direction parallel to said second axis.

11. The converting device according to claim 10, wherein said longitudinal base of said first travel frame includes two outside arms extending in parallel opposite one another, and in a direction away from said longitudinal base, and at right angles thereto, and said converting device further including a second travel frame nestled between said outside arms, and being slidable therebetween in a direction substantially parallel to said first axis.

12. The converting device according to claim 11 wherein said second travel frame includes said tape dispensing control means in the form of a numeric key pad provided with at least ten actuating keys, at least a four digit display, and a plurality of function buttons providing at least for an offset mode, a length mode, a reset mode, and a start mode.

13. The converting device according to claim 1, wherein said tape selection means comprises a manually actuatable guide means for selecting said one of said tapes, and wherein said carriage includes a pair of actuatable drive wheels.

14. The converting device according to claim 13, wherein said plurality of identifiable tapes includes four tapes, and wherein said polygonal cross-section is a square cross-section having four sides corresponding to said four tapes, respectively.

15. The converting device according to claim 13, wherein said carriage of said converting device comprises first and second axles coaxial with a reel-moving shaft, and the shaft of the drive wheels, respectively, and solenoid-actuatable first and second clutch brake assemblies coaxial with said reel-selection shaft, and said shaft of the drive wheels, respectively.

16. The converting device according to claim 13, wherein said tape holding means includes a reel holder mounted on said carriage of said converting device, said reel holder being adapted to hold a plurality of tape supply reels, and wherein said actuatable guide means substantially define a first plane, and include a U-shaped bracket having arms extending parallel with, and opposite to one another, and being formed with horizontally aligned openings, respectively, a manually operable reel-selector bar extending at an obtuse angle to said plane of said guide means from an interior of said carriage, and wherein said side opposite to said one side is formed with a longitudinal guide slot, extending at right angles to said second axis, and with a plurality of reel-identifying indents communicating with said horizontal guide slot, and corresponding to a plurality of respective tape-carrying reels, a reel-moving shaft having a polygonal cross-section on a center portion thereof, fitting into said aligned openings of said arms, and carrying reel-coupling means slidably connected to said reel-moving shaft for positioning the latter opposite a selected of said reels, whereby a selected one of said one of said tapes is manually movable in a direction parallel to said second axis, and is automatically movable along a direction substantially parallel to said first axis, until said one of said tapes reaches said tape exit slot formed in said carriage, and, thereafter is movable by said control means, until said predetermined length is reached, and is adhesively superimposable by means of said cooperating and mating ridges onto said timing chart at a desired location of said one of said tapes.

17. The converting device according to claim 16, wherein said moving means comprises an actuatable electric motor provided with a pulley, and rotatably secured to said carriage, and belt-and/or chain means engageable with said motor, and with said first and second axles, respectively.

18. The converting device according to claim 17, wherein said carriage comprises actuable brake and clutch means selectively acting as a brake or a clutch, respectively, whereby each of said brake and clutch means is actuatable to be positively coupled to each of said-axles, respectively, or be free-wheeling.

19. The converting device according to claim 17, wherein said carriage further comprises a drive solenoid having a housing, a plunger substantially resting within said housing, but having one end thereof disposed outside of said housing, a restraining spring extending between said housing and an other end of said plunger, a ball-joint coupling having one end joined to said one end of said plunger, and a splined shaft joined to the other end of said plunger, said housing being substantially cylindrical and rigid with said drive solenoid, and having an end friction surface thereof facing away from said solenoid, a brake/clutch disk having a splined bore, so as to be slidable, but not rotatable on said splined shaft, each lateral side of said brake/clutch disk having a clutch friction surface, a timing-belt pulley having a friction surface facing one of said friction surfaces of said brake/clutch disk, and having an outwardly extending driving shaft attached thereto, whereby, on said solenoid being energized, said friction surface of said pulley engages said one of said friction surfaces of said brake/clutch disk, so as to be coupled thereto, so that said driving shaft is drivable, while, on said solenoid being de-energized, said restraining spring retracts said plunger, so that the other of said friction surfaces of said brake/clutch disk is coupled to said end friction surface of said housing, so that said pulley and its driving shaft become free-wheeling.

20. In a converting device for converting a box score in a simulated hockey game eventually to final statistics relating to composite power play, composite penalty efficiency, two-player power play, two-player penalty efficiency, major power play, major penalty efficiency, composite hot seat, hot seat two-player disadvantage, hot seat major disadvantage, or earned goal average, and wherein said final statistics are, in turn, obtainable from intermediate statistical data, the improvement being wherein said intermediate statistical data are identifiable by a combination of respective indicia, and are feedable into a calculating means so as to obtain final statistics therefrom, comprising in combination:

a means for displaying a time chart;

converting means for obtaining said intermediate statistical data from said box score, said converting device including:

said means for displaying a time chart being calibrated at predetermined intervals, denotable for a first of indicia associated with a first entrant team and a second set of indicia associated with a second entrant team normally opposing said first entrant team;

a visual indicating means for displaying said first set of indicia and said second set of indicia;

a measuring means for measuring and comparing said first set of indicia with said second set of indicia at said predetermined intervals;

means for recording said first set of indicia and said second set of indicia in a visually readable form;

marking means for visually displaying said first set of indicia and said second set of indicia upon said time chart;

said measuring means comparing said first set of indicia and said second set of indicia, said first set of indicia and said second set of indicia each comprising separately an actual number of minutes and seconds served in penalty time in a game by the first team entrant and the second team entrant;

said first set of indicia being indicative of the scoring or defending ability of the first team entrant, said second set of indicia being indicative of the scoring or defending ability of the second team entrant;

said measuring means comparing said first set of indicia and said second set of indicia and producing an output of a comparative ranking of said first set of indicia of said first entrant team with respect to rankings of said second set of indicia of said second team entrant;

means for converting the output to actual time in minutes and seconds;

means for displaying the comparative ranking data onto said visual display.

* * * * *